US007684717B2

(12) United States Patent
Izumi et al.

(10) Patent No.: US 7,684,717 B2
(45) Date of Patent: Mar. 23, 2010

(54) IMAGE FORMING APPARATUS AND IMAGE FORMING METHOD

(75) Inventors: Takao Izumi, Kanagawa-ken (JP); Masato Ogasawara, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 712 days.

(21) Appl. No.: 11/618,066

(22) Filed: Dec. 29, 2006

(65) Prior Publication Data

US 2007/0201888 A1 Aug. 30, 2007

(30) Foreign Application Priority Data

Feb. 28, 2006 (JP) ..... 2006-052268

(51) Int. Cl.
*G03G 15/00* (2006.01)

(52) U.S. Cl. ..... 399/44; 399/55; 399/66

(58) Field of Classification Search ..... 399/44, 399/55, 66

See application file for complete search history.

(56) References Cited

U.S. PATENT DOCUMENTS 5,708,917 A * 1/1998 Kawai et al. ..... 399/44
5,784,668 A * 7/1998 Hyakutake et al. ..... 399/55
5,905,925 A * 5/1999 Kawabata et al. ..... 399/66
2001/0021316 A1 * 9/2001 Izawa et al. ..... 399/66

FOREIGN PATENT DOCUMENTS

JP 02-264278 10/1990
JP 08-190285 7/1996

* cited by examiner

*Primary Examiner*—David M Gray
*Assistant Examiner*—Ryan D Walsh
(74) *Attorney, Agent, or Firm*—Turocy & Watson, LLP

(57) ABSTRACT

An image forming apparatus includes a developing contrast voltage controller to control a developing contrast voltage so as to obtain a desired image density, a transfer condition controller to control transfer conditions for transferring a toner image, an environment sensor to detect an environment, and a correcting coefficient setting unit to refer to a database for pre-registering correcting coefficients to correct the transfer conditions corresponding to the developing contrast voltage and environment and set the correcting coefficients on the basis of the developing contrast voltage controlled by the developing contrast voltage controller and the environment detected by the environment sensor.

20 Claims, 11 Drawing Sheets

FIG. 10A

PRIMARY TRANSFER VOLTAGE CORRECTING COEFFICENT DATABASE

| RELATIVE HUMIDITY (%) | LOW LIMIT THRESHOLD VALUE | UPPER LIMIT THRESHOLD VALUE | $\alpha$ | $\beta$ |
|---|---|---|---|---|
| ~ 29.9 | 200 | 400 | 0.95 | 1. 05 |
| 30. 0 ~ 44. 9 | 180 | 380 | 0.90 | 1. 10 |
| 45. 0 ~ 59. 9 | 160 | 360 | 0.90 | 1. 10 |
| 60. 0 ~ 74. 9 | 140 | 340 | 0.85 | 1. 15 |
| 75. 0 ~ | 120 | 320 | 0.80 | 1. 20 |

FIG. 10B

SECONDARY TRANSFER VOLTAGE CORRECTING COEFFICENT DATABASE

| RELATIVE HUMIDITY (%) | LOW LIMIT THRESHOLD VALUE | UPPER LIMIT THRESHOLD VALUE | $\gamma$ | $\delta$ |
|---|---|---|---|---|
| ~ 29.9 | 200 | 400 | 0.95 | 1. 05 |
| 30. 0 ~ 44.9 | 180 | 380 | 0.90 | 1. 10 |
| 45. 0 ~ 59.9 | 160 | 360 | 0.90 | 1. 10 |
| 60. 0 ~ 74.9 | 140 | 340 | 0.80 | 1. 20 |
| 75. 0 ~ | 120 | 320 | 0.75 | 1. 25 |

IMAGE FORMING APPARATUS AND IMAGE FORMING METHOD

CROSS-REFERENCE TO RELATED APPLICATION

This application is based upon and claims the benefit of priority from the prior Japanese Patent Application No. 2006-52268, filed on Feb. 28, 2006, the entire contents of which are incorporated herein by reference.

BACKGROUND

1. Field of the Invention

The present invention relates to an image forming apparatus and an image forming method and more particularly to an image forming apparatus and an image forming method capable of obtaining a satisfactory transfer property.

2. Description of the Related Art

Recently, an image forming apparatus having an image carrier and a transfer member opposite to it and a transfer process of passing a transfer material between the two by impressing a transfer voltage to the transfer member, thereby transferring toner on the image carrier onto the transfer material has been proposed. In such an image forming apparatus, as an impressing method of the transfer voltage impressed to the transfer member, a constant-voltage control system and a constant-current control system are known.

In the case of the constant-voltage control system, in an N/N environment (an environment at 23° C., and 55% RH), toner can be transferred appropriately, while in an L/L environment (an environment at 10° C. and 20% RH), the resistances of the transfer material, transfer member, and image carrier increase, and a necessary transfer current cannot be obtained, thus defective transfer may occur. On the other hand, in the case of the constant-current control system, in both N/N and L/L environments, toner can be transferred appropriately, though another problem arises. Namely, for example, if the maximum width of transfer materials is the size of A3, when transferring toner onto a transfer material whose width is narrower than the maximum width of transfer materials such as the size of A4-R, since the width of the transfer material is narrow, the transfer member directly makes contact with the image carrier, and most of the current is carried through the part coated with no transfer material, and no current is carried through the part with the transfer material coated, thus no necessary transfer current is obtained, causing defective transfer.

Accordingly, for example, as shown in Japanese Patent Application Publication No. 2-264278, a control system in combination of the constant-voltage control and constant-current control so as to allow a transfer belt to make contact with a transfer roller when no sheet of paper (transfer material) is loaded, execute constant-current control for the transfer roller, thereby measure a voltage V1 generated on the transfer roller, and when actually transferring onto a sheet of paper, execute constant-voltage control at a voltage of V2 higher than V1 is proposed.

According to the control method proposed in Japanese Patent Application Publication No. 2-264278, in consideration of the transfer bias partial voltage due to the resistance between the sheet of paper and the toner, V2 is decided by multiplying V1 by a predetermined coefficient R, so that in every environment and regardless of change in the size of transfer materials, a stable and satisfactory transfer property can be obtained always.

Further, for example, as indicated in Japanese Patent Application Publication No. 8-190285, a method for forming a toner image on the surface of a photosensitive drum, directly impressing a bias voltage due a constant current to the surface to detect a voltage V1, allowing the surface of a transfer material to make contact with the image forming area and marginal area of the surface of the photosensitive drum, impressing the bias voltage due to the constant current to the part of the rear of the transfer material opposite to the marginal area to detect a voltage V2, calculating a predetermined transfer voltage on the basis of these voltages V1 and V2, and impressing the calculated transfer voltage to the part opposite to the image forming area of the rear of the transfer material is proposed.

According to the control method proposed in Japanese Patent Application Publication No. 8-190285, the transfer voltage is calculated in consideration of not only the resistance of the transfer means such as the transfer roller but also the resistance of the transfer material. By doing this, for transfer materials of various kinds and weights, in various kinds of environments, a stable and satisfactory transfer property can be obtained.

However, according to the control methods proposed in Japanese Patent Application Publication No. 2-264278 and Japanese Patent Application Publication No. 8-190285, the resistances of the transfer roller, transfer belt, transfer material, and toner are measured or estimated correctly, thus an appropriate transfer voltage can be set. However, the transfer voltage varies with the magnitude of the charge amount of toner, so that if the charge amount of toner is shifted from the ordinary value for some reason, a problem arises that an appropriate transfer voltage cannot be impressed.

SUMMARY

The present invention was developed with the foregoing in view and is intended to provide an image forming apparatus and an image forming method for obtaining a satisfactory transfer property even if the charge amount of toner and environment are changed.

According to the embodiment of the present invention, there is provided an image forming apparatus comprising control means for controlling a developing contrast voltage so as to obtain a desired image density; transfer condition control means for controlling transfer conditions for transferring a toner image; environment detecting means for detecting an environment; and correcting coefficient setting means for referring to a database for pre-registering correcting coefficients for correcting the transfer conditions corresponding to the developing contrast voltage and environment and setting the correcting coefficients on the basis of the developing contrast voltage controlled by the control means and the environment detected by the environment detecting means.

Further, according to the embodiments of the present invention, there is provided an image forming method comprising controlling a developing contrast voltage so as to obtain a desired image density; controlling transfer conditions for transferring a toner image; detecting an environment; and referring to a database for pre-registering correcting coefficients for correcting the transfer conditions corresponding to the developing contrast voltage and the environment and setting the correcting coefficients on the basis of the developing contrast voltage controlled and the environment detected.

BRIEF DESCRIPTION OF THE DRAWINGS

FIGS. 10A and 10B are drawings showing constitution examples of the database managed by the correcting coefficient database shown in FIG. 2;

DETAILED DESCRIPTION OF THE EMBODIMENTS

Before explaining the embodiments of the present invention, the correspondence between the invention stated in the claims and the "embodiments of the invention" will be illustrated. The illustration confirms that the embodiments supporting the invention stated in the claims are described in this specification. Therefore, even if there is any embodiment which is not positively described in the "embodiments of the invention" as a one corresponding to the invention, it does not mean that the embodiment does not correspond to the invention. Inversely, even if the embodiment is described here as a one corresponding to the invention, it does not mean that the embodiment does not correspond to an invention other than the present invention.

Hereinafter, the embodiments of the present invention will be explained with reference to the accompanying drawings.

Figure 1:
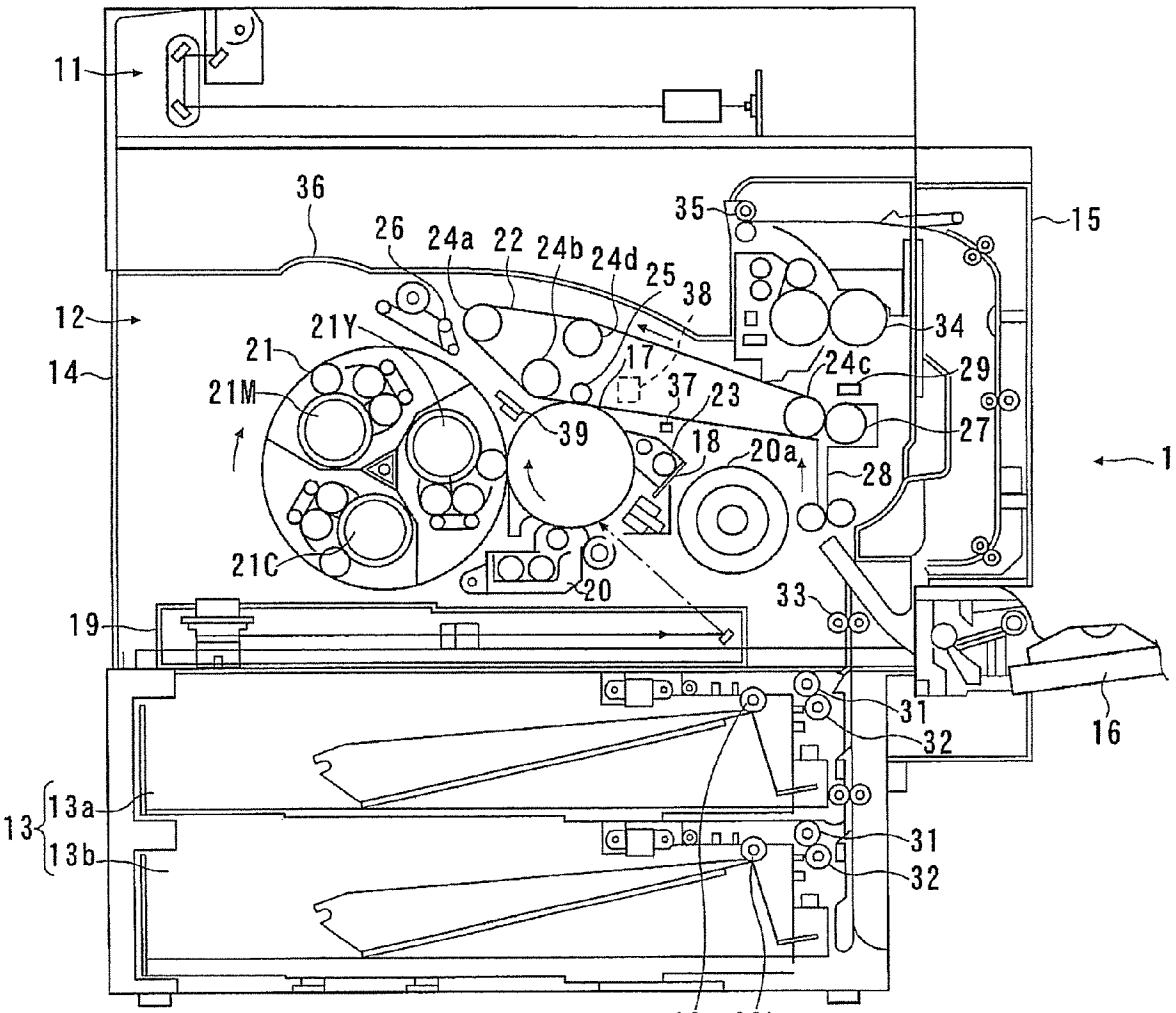
FIG. 1 is a block diagram showing the mechanical constitution of the schematic section of the image forming apparatus to which the present invention is applied.

FIG. 1 shows the constitution of the schematic section of an image forming apparatus 1 to which the present invention is applied.

The image forming apparatus 1 stores, in a housing 14, a scanner unit 11, an image forming unit 12, and a paper supply unit 13. The scanner unit 11 irradiates light to a document (not drawn) set on the document table, leads the reflected light from the document to the light receiving element via a plurality of optical members, converts it photo-electrically, and then outputs image data. Further, the image forming unit 12 outputs the image data read from the document by the scanner unit 11 or an image based on image data inputted from an external apparatus not drawn onto a sheet of paper (transfer material). Furthermore, the paper supply unit 13 supplies sheets of paper to the image forming unit 12.

On the housing 14, an automatic duplex unit 15 and a manual paper supply unit 16 are mounted removably. The automatic duplex unit 15 overturns the sheet of paper on one side of which an image is formed by the image forming unit 12, supplies it again to the image forming unit 12, and then forms an image on the other side. The manual paper supply unit 16 supplies manually sheets of paper to the image forming unit 12.

Next, the image forming unit 12 will be explained in detail. The image forming unit 12 has a photosensitive drum 17 as an image carrier having the pipe shaft extending in the longitudinal direction (the depth direction of the drawing) of the image forming apparatus 1. Further, the image carrier is not limited to the drum shape and it may be a photosensitive belt. Around the photosensitive drum 17, as auxiliary devices, a main charger 18, an exposure unit 19, a black developing device 20, a revolver 21 as a color developing device, an intermediate transfer belt 22 as a toner image forming medium, and a drum cleaner 23 are sequentially installed in the rotational direction (the direction of the arrow shown in the drawing) of the photosensitive drum 17. Further, the process cartridge not drawn is composed of the photosensitive drum 17, main charger 18, black developing device 20 or revolver 21, and drum cleaner 23 and those units can be installed removably in the image forming apparatus 1.

The main charger 18 charges the outer peripheral surface of the photosensitive drum 17 at a predetermined potential. The exposure unit 19 is arranged in the neighborhood of the lower end of the image forming unit 12 and exposes the surface of the photosensitive drum 17 charged at the predetermined potential and forms an electrostatic latent image based on image data. When forming a color image, the exposure unit 19 exposes the surface of the photosensitive drum 17 on the basis of color-resolved image data and forms electrostatic latent images of the respective colors.

The black developing device 20 is arranged between the photosensitive drum 17 and the exposure unit 19, that is, opposite to the photosensitive drum 17 from underneath. The black developing device 20 adheres and develops black toner to the electrostatic latent image for black which is formed on the surface of the photosensitive drum 17 by the exposure unit 19 and forms a black toner image on the surface of the photosensitive drum 17. The black developing device 20 includes a mixer for stirring and supplying toner and a developing roller arranged opposite to it on the surface of the photosensitive drum 17 via a predetermined developing gap. The black developing device 20 is movably installed so that the developing roller separates from or makes contact with the surface of the photosensitive drum 17. Further, to the black developing device 20, toner is supplied from a toner cartridge 20*a* via a supply path not drawn.

The revolver 21 is installed in the neighborhood of the photosensitive drum 17 so as to rotate clockwise. The revolver 21 includes a yellow developing device 21Y, a magenta developing device 21M, and a cyan developing device 21C which have the same structure as that of the black developing device 20. The developing devices are removably stored in the revolver 21 side by side in the rotational direction of the revolver 21. And, the developing devices 21Y, 21M, and 21C of the respective colors, by rotating the revolver 21 clockwise, are selectively arranged opposite to each other from the side of the photosensitive drum 17 to the surface thereof.

The black developing device 20, since the use frequency is higher than the developing devices of the other colors, is installed separately from the revolver 21 storing the developing devices of the other colors. By doing this, the toner storage amount of the developing device and toner cartridge can be made different from those of the developing devices of the other colors, thus the maintenance count such as toner supply can be reduced.

The intermediate transfer belt 22 is arranged above the photosensitive drum 17. The intermediate transfer belt 22 is wound and stretched by a driving roller 24*a* having the rotary shaft extending the longitudinal direction (the depth direction of the drawing) of the image forming apparatus 1, a driven roller 24*b*, a driven roller 24*c*, and a tension roller 24*d*. The driving roller 24*a* is fixedly installed on the housing 14 above the revolver 21. The tension roller 24*d* is pressed from the inside of the intermediate transfer belt 22 to the outside thereof so as to give predetermined tension to the intermediate transfer belt 22.

Inside the intermediate transfer belt 22, to allow the intermediate transfer belt 22 to make contact with the surface of the photosensitive drum 17 and transfer a toner image formed on the surface of the photosensitive drum 17 to the intermediate transfer belt 22, a primary transfer roller 25 is installed. The primary transfer roller 25, so as to press the intermediate transfer belt 22 to the surface of the photosensitive drum 17 at a predetermined pressure, is pressed toward the photosensitive drum 17. Further, the primary transfer unit is formed by the primary transfer roller 25 and intermediate transfer belt 22 installed around it.

Around the intermediate transfer belt 22, a belt cleaner 26 and a secondary transfer roller 27 are installed removably on the belt surface. The belt cleaner 26 is installed on the outer periphery of the driving roller 24*a* via the intermediate transfer belt 22 above the revolver 21. The secondary transfer roller 27 of the image forming apparatus 1 indicated in this embodiment has a constitution that the outside diameter is several tens mm (for example, 28 mm), and the sponge surface made of epichloro rubber is covered with an epichloro rubber tube, and the rubber hardness is several tens degrees (for example, 25 to 30 degrees), and the volume resistance is 10 Ω (for example, 13 Ω). Further, the secondary transfer roller 27 is installed at the position across a vertical conveying path 28 via the intermediate transfer belt 22 between itself and the driven roller 24*c* and this portion forms the secondary transfer unit. Further, above the secondary transfer roller 27, a paper separation unit 29 is arranged. The drum cleaner 23 is arranged in contact with the photosensitive drum 17.

The paper supply unit 13 has two paper supply cassettes 13*a* and 13*b*. At the right upper ends of the paper supply cassettes 13*a* and 13*b* shown in the drawing, pick-up rollers 30 (30*a* and 30*b*) for taking out the uppermost sheets of paper stored in the cassettes are installed. At the neighboring positions on the downstream side in the paper take-out directions by the pick-up rollers 30, a feed roller 31 and a separation roller 32 are arranged opposite to each other. Further, at the neighboring positions on the right of the paper supply cassettes 13*a* and 13*b* shown in the drawing, the vertical conveying path 28 extending almost vertically through the secondary transfer area where the intermediate transfer belt 22 and secondary transfer roller 27 are in contact with each other is installed. On the vertical conveying path 28, a plurality of conveying roller pairs 33 for holding and rotating sheets of paper are installed.

Above the paper ejection unit in the secondary transfer area, the paper separation unit 29 is installed along the vertical conveying path 28. On the vertical conveying path 28 passing the recording medium separation unit 29 and extending upward more, a fixing device 34 for heating, pressurizing, and fixing a toner image transferred onto a sheet of paper is installed.

Further, exit rollers 35 for ejecting a sheet of paper with an image formed to a paper receiving tray 36 are installed.

Furthermore, in the neighborhood of the photosensitive drum 17, a photosensitive drum surface voltage measure 37 for measuring the surface potential of the photosensitive drum 17 is installed. Further, at a predetermined position in the image forming apparatus 1, an environment sensor 38 for detecting an environment such as temperature and relative humidity inside the image forming apparatus 1 is installed. Further, in the neighborhood of the photosensitive drum 17, a toner adherence amount measure 39 for measuring the toner adherence amount adhered to the photosensitive drum 17 is installed.

Next, the color image forming operation by the image forming apparatus 1 will be explained.

As an initial operation, the black developing device 20 moves downward and separates from the surface of the photosensitive drum 17, and the revolver 21 rotates clockwise, thus the yellow developing device 21Y faces the surface of the photosensitive drum 17. Further, the belt cleaner 26 rotates counterclockwise centering on the support axis thereof and separates from the intermediate transfer belt 22, and the secondary transfer roller 27 moves in the direction (rightward in the drawing) separating from the vertical conveying path 28 and separates from the intermediate transfer belt 22.

And, image data is read from a document not drawn by the scanner unit 11 or image data is input from an external apparatus not drawn. Furthermore, the photosensitive drum 17 rotates clockwise and the surface of the photosensitive drum 17 is uniformly charged at a predetermined potential by the main charger 18. At this time, the intermediate transfer belt 22 rotates counterclockwise at the same speed as the peripheral speed of the photosensitive drum 17.

Firstly, on the basis of color-resolved yellow image data, the exposure unit 19 operates and on the surface of the photosensitive drum 17, an electrostatic latent image for yellow is formed. At this time, the exposure timing is synchronized by detecting a detection mark (not drawn) attached to the inside of the intermediate transfer belt 22 by a detector not drawn.

The electrostatic latent image for yellow formed on the surface of the photosensitive drum 17 by the yellow developing device 21Y is adhered with yellow toner and developed, thus a yellow toner image is formed on the surface of the photosensitive drum 17. The yellow toner image formed on the surface of the photosensitive drum 17 in this way is moved by rotation of the photosensitive drum 17 and passes through the primary transfer area in contact with the intermediate transfer belt 22.

At this time, to the primary transfer roller 25, a bias voltage with reverse polarity of the charging potential of toner is given and the yellow toner image on the surface of the photosensitive drum 17 is transferred onto the intermediate transfer belt 22.

After the yellow toner image is transferred onto the intermediate transfer belt 22, yellow toner remaining on the surface of the photosensitive drum 17 without being transferred is removed by the drum cleaner 23. At this time, the residual electric charge on the surface of the photosensitive drum 17 is removed simultaneously.

To prepare for next forming of an electrostatic latent image for magenta on the photosensitive drum 17, the surface of the photosensitive drum 17 is uniformly charged by the main charger 18, and the revolver 21 is rotated, thus the magenta developing device 21M faces the surface of the photosensitive drum 17.

In this state, the aforementioned series of processes, that is, exposure, development, and primary transfer onto the intermediate transfer belt 22 are executed and a magenta toner image is superimposed and transferred onto the yellow toner image on the intermediate transfer belt 22.

After a cyan toner image is transferred similarly, the revolver 21 rotates so that the developing devices 21Y, 21M, and 21C do not face the surface of the photosensitive drum 17, and the black developing device 20 moves up instead and faces the surface of the photosensitive drum 17. In this state, the same process as the aforementioned process is executed, and the black toner image is superimposed on the yellow toner image, magenta toner image, and cyan toner image, thus those images are transferred onto the intermediate transfer belt 22.

When the toner images of all the colors are superimposed on the intermediate transfer belt 22 in this way, the secondary transfer roller 27 moves toward the driven roller 24*c* and makes contact with the intermediate transfer belt 22. Further, the belt cleaner 26 also makes contact with the intermediate transfer belt 22. In this state, the toner images of all the colors superimposed on the intermediate transfer belt 22 are moved by rotation of the intermediate transfer belt 22 and pass through the secondary transfer area where the intermediate transfer belt 22 and secondary transfer roller 27 make contact with each other.

At this time, the sheets of paper taken out from the paper supply cassettes 13*a* and 13*b* by the pick-up rollers 30*a* and 30*b* are conveyed upward on the vertical conveying path 28 by conveying rollers 149 and are sent into the secondary transfer area at predetermined timing.

And, via the secondary transfer roller 27 impressed with a bias voltage of reverse polarity of the potential of the toner image of each color by a power source not drawn, the toner images of the respective colors on the intermediate transfer belt 22 are transferred onto a sheet of paper. After the toner images are transferred onto the sheet of paper, the residual toner on the intermediate transfer belt 22 is removed by the belt cleaner 26. The sheet of paper onto which the toner images of the respective colors are all transferred passes thereafter through the recording medium separation unit 29 and is heated and pressurized by the fixing device 34, and the toner images of the respective colors are fixed on the sheet of paper, thus a color image is formed. The sheet of paper on which the color image is formed is ejected onto the paper receiving tray 36 via the exit rollers 35 installed on the downstream side of the fixing device 34.

Figure 2:
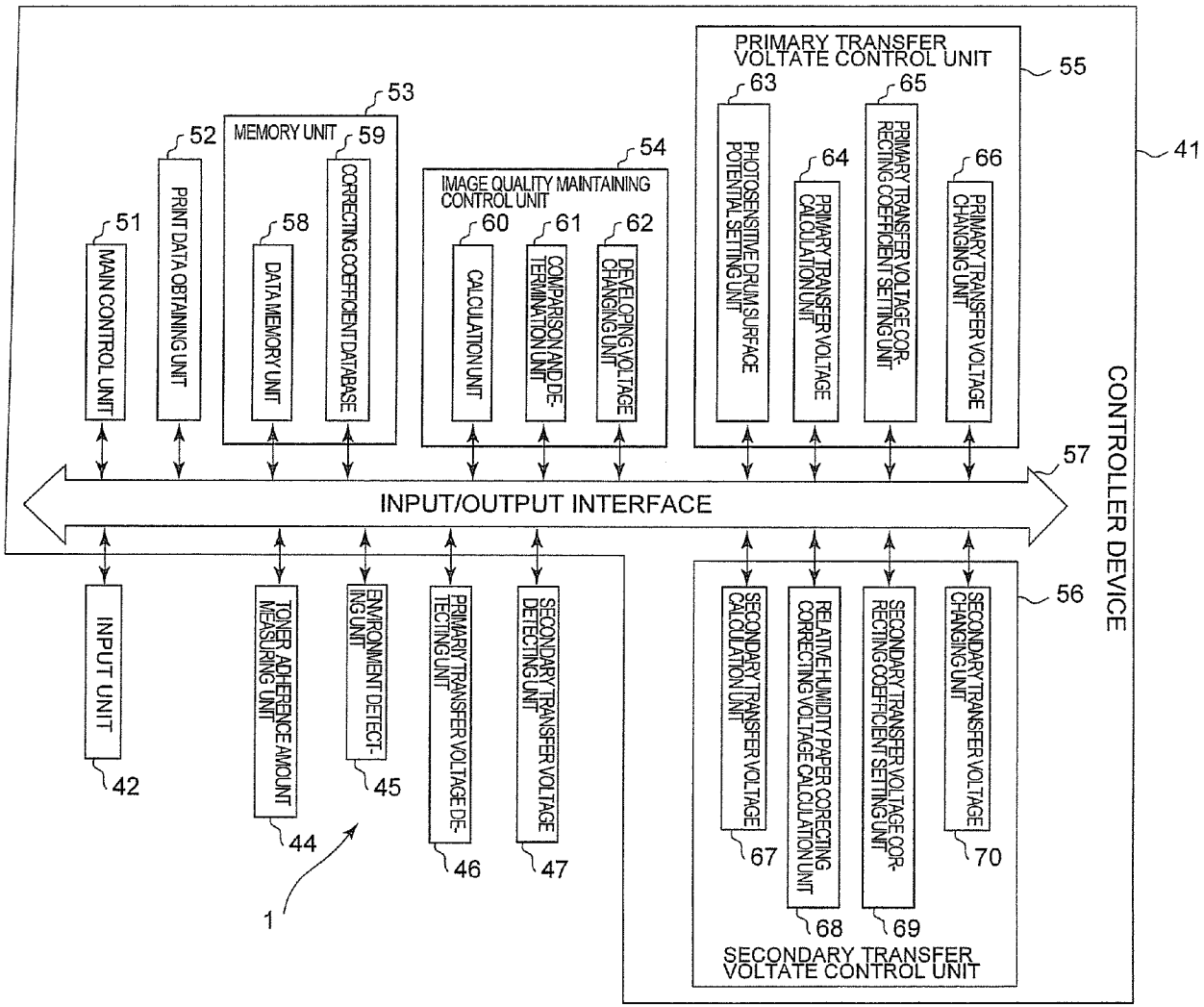
FIG. 2 is a block diagram showing the schematic and functional constitution of the control system inside the image forming apparatus shown in FIG. 1.

FIG. 2 shows the schematic and functional constitution of the control system inside the image forming apparatus 1 shown in FIG. 1.

As shown in FIG. 2, to a controller device 41, an input unit 42, a toner adherence amount measuring unit 44, an environment detecting unit 45, a primary transfer voltage detecting unit 46, and a secondary transfer voltage detecting unit 47 are connected.

The controller device 41 is structured so as to connect a main control unit 51, a print data obtaining unit 52, a memory unit 53, an image quality maintaining control unit 54, a primary transfer voltage control unit 55, and a secondary transfer voltage control unit 56 via an input/output interface 57.

The main control unit 51 is composed of a central processing unit (CPU) or a micro processing unit (MPU) and a random access memory (RAM), and generates various control signals and collectively controls the image forming apparatus 1.

The print data obtaining unit 52 obtains print data from the input unit 42 by operating the display panel or buttons by a user or from an external apparatus (not drawn) via an electric cable and supplies the obtained print data to a data memory unit 58 of a memory unit 53. The print data includes, for example, data concerning the kind and size of sheets of paper (transfer materials) on which images and characters are printed and print data of images and characters to be printed.

The memory unit 53 is composed of the data memory unit 58 and a correcting coefficient database 59.

The data memory unit 58 obtains the print data supplied from the print data obtaining unit 52 and stores the obtained print data. Further, the data memory unit 58, according to an instruction of the main control unit 51, supplies properly various data stored in the respective units of the image forming apparatus 1.

The correcting coefficient database 59 is composed of a primary transfer voltage correcting coefficient database and a secondary transfer voltage correcting coefficient database, and in the primary transfer voltage correcting coefficient database, with respect to the primary transfer voltage, the temperature and relative humidity and the correcting coefficients for the temperature and relative humidity are pre-registered in correspondence with each other and in the secondary transfer voltage correcting coefficient database, with respect to the secondary transfer voltage, the temperature and relative humidity and the correcting coefficients for the temperature and relative humidity are pre-registered in correspondence with each other.

The image quality maintaining control unit 54 is composed of a calculation unit 60, a comparison and determination unit 61, and a developing voltage changing unit 62.

Figure 3:
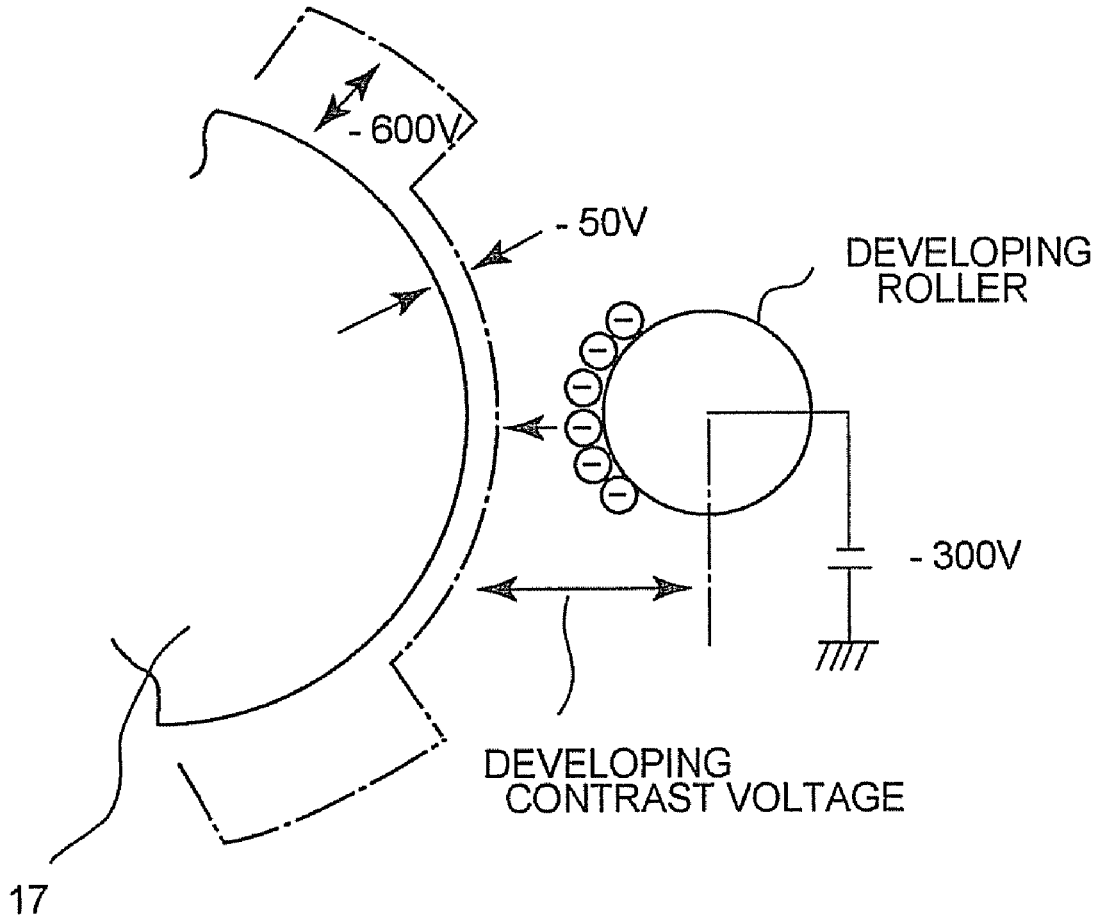
FIG. 3 is a schematic view for explaining the developing contrast voltage.

The calculation unit 60, on the basis of coefficients K1 to K4 (the relationship between an exposing portion potential VL and a non-exposing portion potential VO to a grid bias voltage VG) pre-stored in the data memory unit 58 as known data, calculates a standard developing contrast voltage VC and a background voltage VBG and calculates the grid bias voltage VG and developing bias voltage VD corresponding to the calculated standard developing contrast voltage VC and background voltage VBG. The developing contrast voltage is a difference voltage between the surface potential of the photosensitive drum and the developing bias potential. As shown in FIG. 3, with respect to the electrostatic latent image formed on the surface of the photosensitive drum 17, assuming the potential of the non-exposing portion as −600 V, the potential of the exposing portion as −50 V, and the developing bias voltage as −300 V, +250 V is the developing contrast voltage.

Further, the calculation unit 60 calculates a deviation on the basis of comparison and determination result supplied from the comparison and determination unit 61 and calculates a correcting developing contrast voltage ΔVC and a correcting background voltage ΔVBG on the basis of the calculated deviation. The calculation unit 60, on the basis of the standard developing contrast voltage VC and background voltage VBG and the calculated correcting developing contrast voltage ΔVC and correcting background voltage ΔVBG, calculates a developing contrast voltage VC and a background voltage VBG which are impressed actually, calculates a grid bias voltage VG and a developing bias voltage VD corresponding to the calculated developing contrast voltage VC and standard background voltage VBG, and supplies calculation results to the developing voltage changing unit 62.

The comparison and determination unit 61 reads data concerning the standard value of the toner adherence amount stored in the data memory unit 58, refers to data concerning the standard value of the toner adherence amount read, compares and determines it with the measured data of the toner adherence amount supplied from the toner adherence amount measuring unit 44, and supplies the comparison and determination results to the calculation unit 60.

The developing voltage changing unit 62, on the basis of the calculated results supplied from the calculation unit 60, changes the developing contrast voltage VC, background voltage VBG, grid bias voltage VG, and developing bias voltage VD. The developing voltage changing unit 62 supplies the data concerning the developing contrast voltage VC, background voltage VBG, grid bias voltage VG, and developing bias voltage VD which are impressed actually to the data memory unit 58.

The primary transfer voltage control unit 55 is composed of a photosensitive drum surface potential setting unit 63, a primary transfer voltage calculation unit 64, a primary transfer voltage correcting coefficient setting unit 65, and a primary transfer voltage changing unit 66.

The photosensitive drum surface potential setting unit 63 reads the data concerning the changed grid bias voltage VG stored in the data memory unit 58. The photosensitive drum surface potential setting unit 63 controls the main charger 18, impresses the grid bias voltage VG on the basis of the data concerning the read and changed grid bias voltage VG, and charges the photosensitive drum 17 at an appropriate voltage VO at time of image forming.

The primary transfer voltage calculation unit 64 calculates the resistance of the primary transfer unit on the basis of a primary transfer voltage detected signal supplied from the primary transfer voltage detecting unit 46 and calculates a standard primary transfer voltage for generating a predetermined current on the basis of the calculated resistance of the primary transfer unit. The primary transfer voltage calculation unit 64, on the basis of the calculated standard primary transfer voltage and the primary transfer voltage correcting coefficient data supplied from the primary transfer voltage correcting coefficient setting unit 65, calculates the primary transfer voltage after correction according to the toner charge amount and supplies the calculation results to the primary transfer voltage changing unit 66.

The primary transfer voltage correcting coefficient setting unit 65 reads the database managed by the correcting coefficient database 59 of the memory unit 53 and reads the data concerning the developing contrast voltage VC stored in the data memory unit 58. The primary transfer voltage correcting coefficient setting unit 65 refers to the primary transfer voltage correcting coefficient database managed by the read correcting coefficient database 59, on the basis of an environment detecting signal supplied from the environment detecting unit 45 and the data concerning the read developing contrast voltage VC, sets the primary transfer voltage correcting coefficient, and supplies the primary transfer voltage correcting coefficient data which is the data of the set primary transfer voltage correcting coefficient to the primary transfer voltage calculation unit 64.

The primary transfer voltage changing unit 66 changes the primary transfer voltage on the basis of the calculation results supplied from the primary transfer voltage calculation unit 64.

The secondary transfer voltage control unit 56 is composed of a secondary transfer voltage calculation unit 67, a relative humidity paper correcting voltage calculation unit 68, a secondary transfer voltage correcting coefficient setting unit 69, and a secondary transfer voltage changing unit 70.

The secondary transfer voltage calculation unit 67 calculates the resistance of the secondary transfer unit on the basis of a secondary transfer voltage detected signal supplied from the secondary transfer voltage detecting unit 47 and calculates a standard secondary transfer voltage for generating a predetermined current on the basis of the calculated resistance of the secondary transfer unit. The secondary transfer voltage calculation unit 67, on the basis of the calculated standard secondary transfer voltage, the calculation results supplied from the relative humidity paper correcting voltage calculation unit 68, and the secondary transfer voltage correcting coefficient data supplied from the secondary transfer voltage correcting coefficient setting unit 69, calculates the secondary transfer voltage after correction according to the toner charge amount and supplies the calculation results to the secondary transfer voltage changing unit 70.

The relative humidity paper correcting voltage calculation unit 68 reads the data concerning the paper kind included in the print data stored in the data memory unit 58, on the basis of the data concerning the read paper kind and the environment detecting signal supplied from the environment detecting unit 45, calculates the relative humidity paper correcting voltage corresponding to the paper kind selected by a user and the detected relative humidity, and supplies the calculation results to the secondary transfer voltage calculation unit 67.

The secondary transfer voltage correcting coefficient setting unit 69 reads the secondary transfer voltage correcting coefficient database managed by the correcting coefficient database 59 of the memory unit 53 and reads the data concerning the developing contrast voltage VC stored in the data memory unit 58. The secondary transfer voltage correcting coefficient setting unit 69 refers to the secondary transfer voltage database managed by the read correcting coefficient database 59, on the basis of the environment detecting signal supplied from the environment detecting unit 45 and the data concerning the read developing contrast voltage VC, sets the secondary transfer voltage correcting coefficient, and supplies the secondary transfer voltage correcting coefficient data which is the data of the set secondary transfer voltage correcting coefficient to the secondary transfer voltage calculation unit.

The secondary transfer voltage changing unit 70 changes the secondary transfer voltage on the basis of the calculation results supplied from the secondary transfer voltage calculation unit 67.

The input unit 42 is installed on the upper part of the image forming apparatus 1 and has an input device including a display panel and buttons for inputting various instructions of a user.

The toner adherence amount measuring unit 44 is composed of, for example, the toner adherence amount measure 39 shown in FIG. 1, measures the toner adherence amount adhered to the photosensitive drum 17 according to an instruction of the main control unit 51, and supplies the measured data of the toner adherence amount to the image quality maintaining control unit 54.

The environment detecting unit 45 is composed of, for example, the environment sensor 38 shown in FIG. 1, detects an environment such as temperature and relative humidity inside the image forming apparatus 1 according to an instruction of the main control unit 51, generates an environment detecting signal on the basis of the detected temperature and relative humidity, and supplies it to the respective units of the controller device 41. Further, the environment detecting signal includes environment data such as the temperature and relative humidity inside the image forming apparatus 1.

The primary transfer voltage detecting unit 46 detects a voltage impressed to the primary transfer unit formed by the primary transfer roller 25 and the intermediate transfer belt 22 around it, generates a primary transfer voltage detecting signal on the basis of the detected voltage, and supplies it to the primary transfer voltage calculation unit 64. Further, the primary transfer voltage detecting signal includes the data concerning the detected voltage impressed to the primary transfer unit.

The secondary transfer voltage detecting unit 47 detects a voltage impressed to the secondary transfer unit formed by the secondary transfer roller 27 and the intermediate transfer belt 22 around it, generates a secondary transfer voltage detecting signal on the basis of the detected voltage, and supplies it to the secondary transfer voltage calculation unit 67. Further, the secondary transfer voltage detecting signal includes the data concerning the detected voltage impressed to the secondary transfer unit.

On the other hand, the transfer voltage varies with the magnitude of the charge amount of toner, so that when calculating an appropriate transfer voltage, it is necessary to measure first the charge amount of toner, though the charge amount of toner cannot be measured directly. However, between the developing contrast voltage VC changed by the image quality maintaining control processing and the toner charge amount, there is a strong mutual relation as shown in FIG. 4.

The mutual relation between the developing contrast voltage VC calculated by the image quality maintaining control processing and the toner charge amount will be explained below by referring to FIG. 4.

Figure 4:
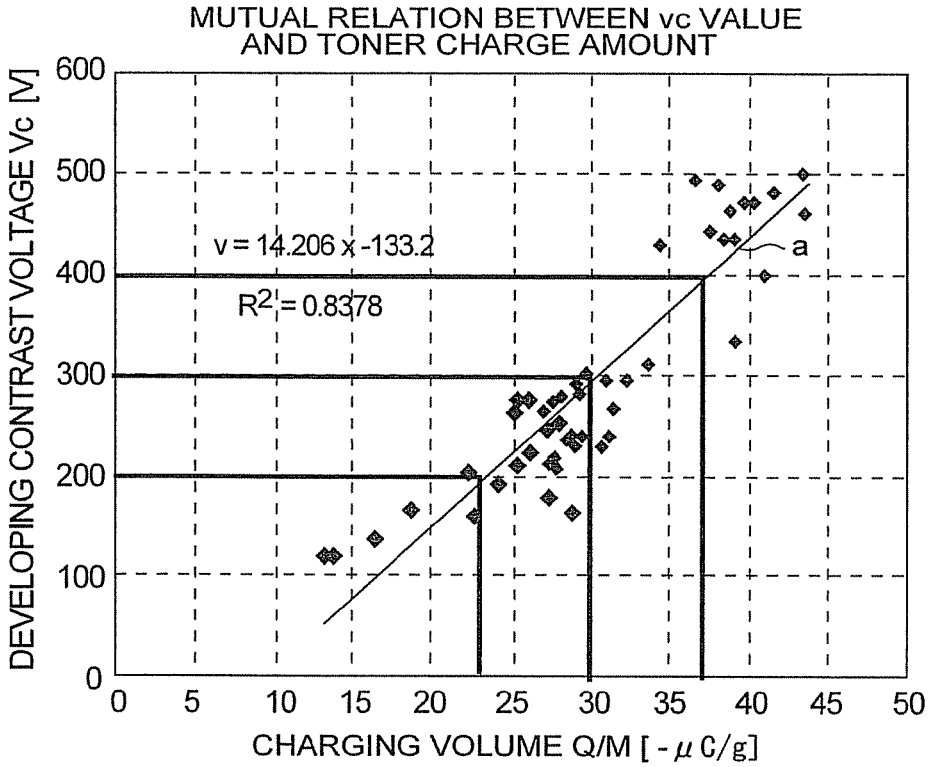
FIG. 4 is a drawing for explaining the mutual relation between the developing contrast voltage VC calculated by the image quality maintaining control process and the charge amount of toner.
Figure 5:
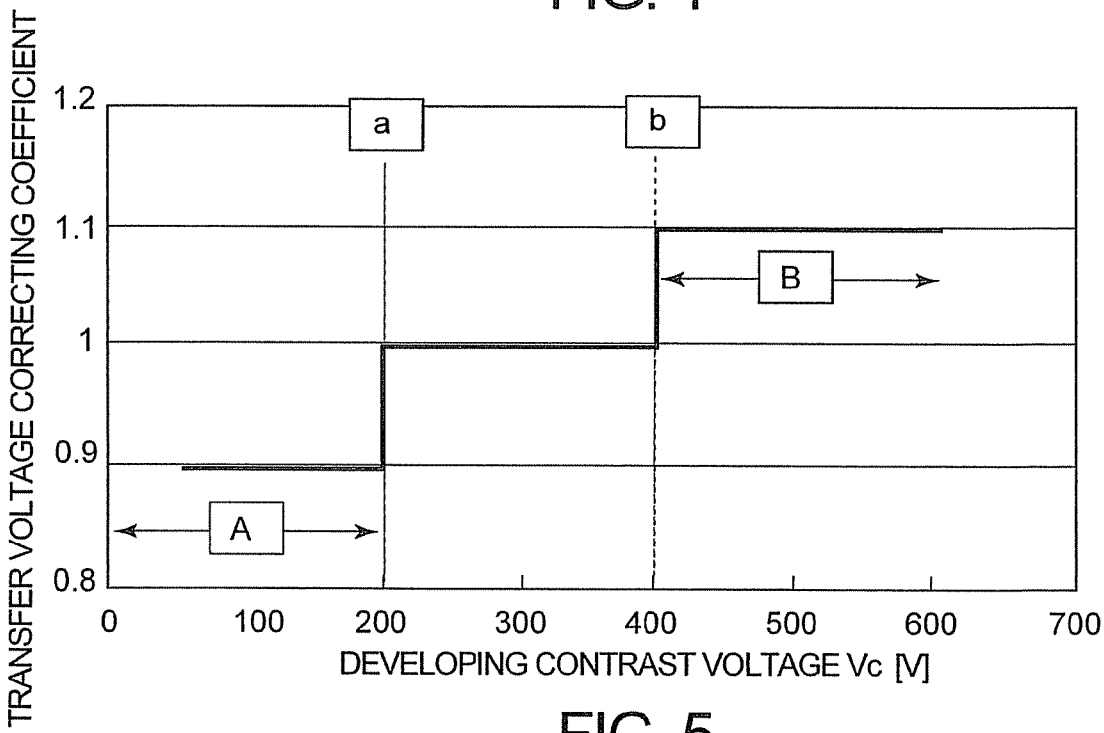
FIG. 5 is a drawing for explaining the method for correcting the transfer voltage according to the charge amount of toner.

As shown by a solid line a in FIG. 4, between the developing contrast voltage VC and the toner charge amount, a linear mutual relation having a predetermined width is recognized. Namely, when the toner charge amount is small, a low developing contrast voltage VC is sufficient, while when the toner charge amount is large, a high developing contrast voltage VC is required.

Therefore, using the mutual relation between the developing contrast voltage VC and the toner charge amount shown in FIG. 4, it can be estimated that when the developing contrast voltage VC calculated by the image quality maintaining control processing is low, the toner charge amount is reduced, while when the developing contrast voltage VC is high, the toner charge amount is increased.

Therefore, when the developing contrast voltage VC calculated by the image quality maintaining control processing is shifted greatly from a predetermined value, it is decided that the toner charge amount is shifted greatly from a predetermined value range and on the basis of the decision result, the transfer voltage can be corrected.

When correcting the transfer voltage from the decision result concerning the magnitude of the toner charge amount, concretely, it is corrected as indicated below.

Namely, when the toner charge amount is increased if a fixed voltage is impressed, generally, the toner adherence amount is reduced. Therefore, to keep the toner adherence amount within a fixed range, it is necessary to increase the voltage according to the magnitude of the toner charge amount.

Therefore, as shown in FIG. 4, for example, the lower limit threshold value and upper limit threshold value of the developing contrast voltage VC at which the toner charge amount can be considered to be within the predetermined value range are respectively preset to 200 V and 400 V. And, the voltage range is divided into three sections (appropriate charging area, low charging area, and high charging area) depending on the value of the developing contrast voltage VC, and as a range (section a-b) of the developing contrast voltage VC at which the toner charge amount can be considered to be within the predetermined value range, a case of 200 V to 400 V is set, and as a range (section A) of the developing contrast voltage VC at which the toner charge amount is below the predetermined value range, a case of less than 200 V is set, and as a range (section B) of the developing contrast voltage VC at which the toner charge amount is above the predetermined value range, a case of more than 400 V is set.

Under the environment condition shown in FIG. 4, in the section a-b which is the appropriate charging area, the transfer voltage correcting coefficient is 1 and the transfer voltage calculated by the ordinary transfer voltage control processing is impressed straight, and in the section A which is the low charging area, the transfer voltage correcting coefficient is, for example, 0.9 and a value obtained by multiplying the transfer voltage calculated by the ordinary primary transfer voltage control processing by a transfer voltage correcting coefficient, for example, 0.9 is impressed, and in the section B which is the high charging area, the transfer voltage correcting coefficient is, for example, 1.1 and a value obtained by multiplying the transfer voltage calculated by the ordinary primary transfer voltage control processing by a transfer voltage correcting coefficient, for example, 1.1 is impressed. By doing this, even if the toner charge amount is changed, a satisfactory transfer property can be obtained. Further, the transfer voltage correcting coefficient is a value varying with the environment conditions such as temperature and relative humidity.

Hereinafter, the primary transfer voltage control processing and secondary transfer voltage control processing using the mutual relation between the developing contrast voltage VC and the toner charge amount will be explained.

The image quality maintaining control processing of the image forming apparatus 1 shown in FIG. 2 will be explained below by referring to the flow chart shown in FIG. 6. Further, the image quality maintaining control processing is performed when the warming-up process of the image forming apparatus 1 is finished.

At Step S1, the main control unit 51 controls a pattern generation circuit not drawn, thereby generates gradation data, thus the exposure unit 19 exposes the photosensitive drum 17 by two gradation patterns of high density and low density for toner adherence amount measurement.

By referring to FIG. 6, the relationship between the surface potential VO of the photosensitive drum 17 (hereinafter, referred to as non-exposing portion potential) to an absolute value VG of the grid bias voltage (hereinafter, referred to as grid bias voltage) outputted from the grid electrode of the main charger 18, the surface potential VL of the photosensitive drum 17 (hereinafter, referred to as exposing portion potential) which is attenuated by overall exposure at a fixed light quantity via the exposure unit 19, and the developing bias voltage VD will be explained. Further, the example shown in FIG. 6 performs reverse development, so that the polarity of the voltage is negative.

Figure 6:
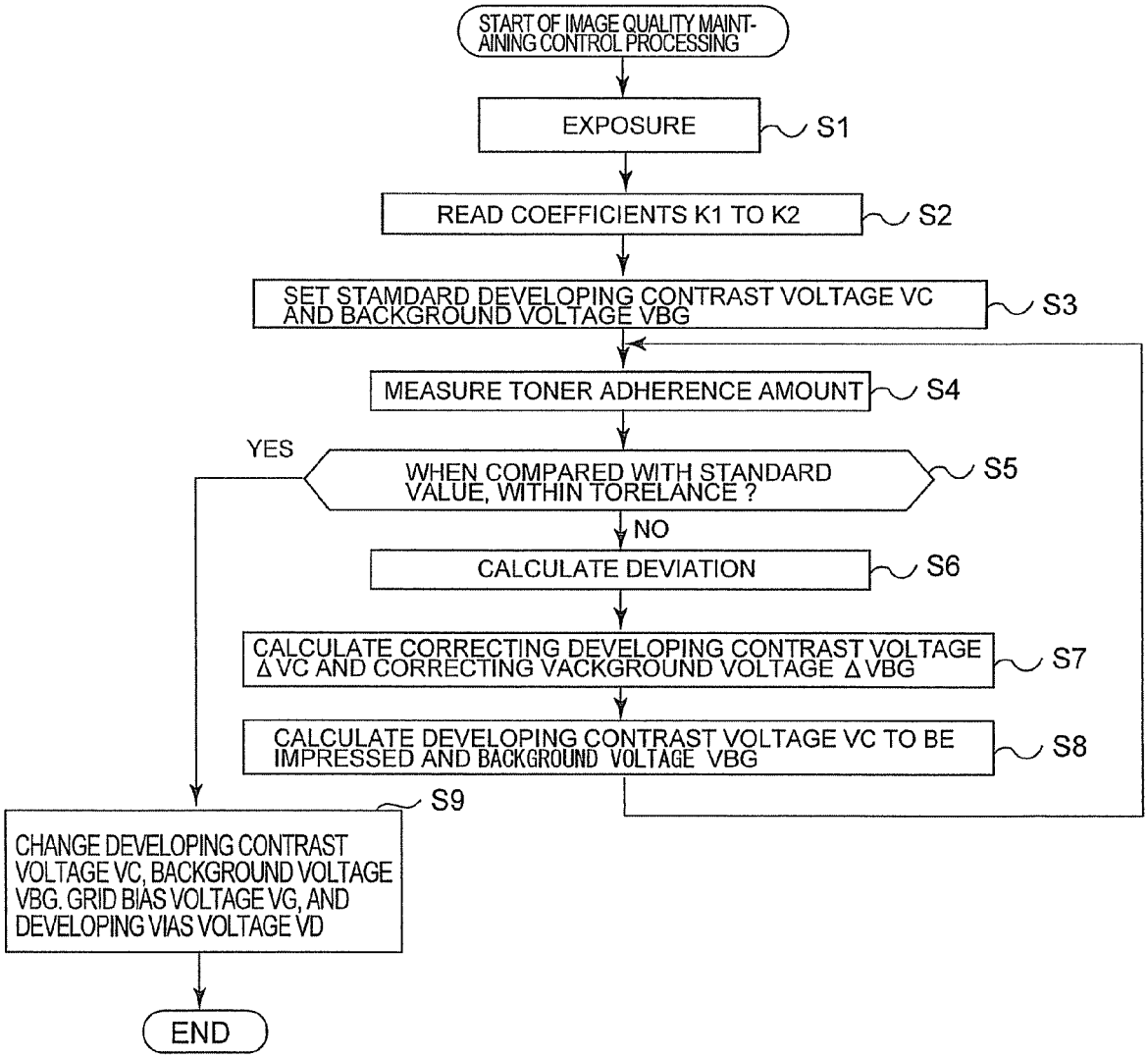
FIG. 6 is a flow chart for explaining the image quality maintaining control process of the image forming apparatus shown in FIG. 2.
Figure 7:
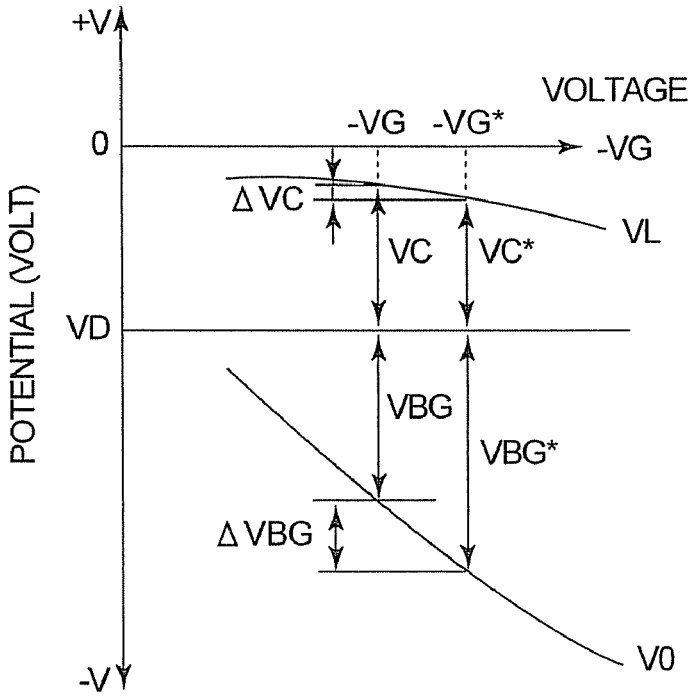
FIG. 7 is graphs for explaining the relationship between the non-exposing portion potential of the photosensitive drum for the absolute value of the grid bias voltage, the exposing portion potential of the photosensitive drum, and the developing bias voltage.

As shown in FIG. 6, when the grid bias voltage VG increases, the absolute values of the non-exposing portion potential VO and exposing portion potential VL reduce respectively. When linearly approximating the exposing portion potential VL and non-exposing portion potential VO to the grid bias voltage VG, they can be expressed by Formula 1 and Formula 2.

$$VO(VG)=K1\times VG+K2 \quad \text{Formula 1}$$

$$VL(VG)=K3\times VG+K4 \quad \text{Formula 2}$$

where symbols K1 to K4 indicate coefficients, and VO, VL, and VG indicate absolute values, and VO (VG) and VL (VG) indicate magnitudes of VO and VL to optional VG.

Generally, the toner adherence amount (developing density) varies with the relationship between the three values of the developing bias voltage VD, exposing portion potential VL, and non-exposing portion potential VO.

Here, firstly, the developing contrast voltage VC and background voltage VBG are defined as Formula 3 and Formula 4.

$$VC=VD(VG)-VL(VG) \quad \text{Formula 3}$$

$$VBG=VO(VG)-VD(VG) \quad \text{Formula 4}$$

where VD (VG) indicates a magnitude of VD to optional VG.

The developing contrast voltage VC participates particularly in the density of the solid portion and the background voltage VBG, in the multi-gradation system using pulse width modulation, participates mainly in the density of the low density portion. Therefore, the toner adherence amount can be changed by the developing contrast voltage VC and background voltage VBG.

Namely, Formula 5 and Formula 6 can be obtained using Formula 1 to Formula 4.

$$VG(VC, VBG)=(VC+VBG-K2+K4)/(K1-K3) \quad \text{Formula 5}$$

$$VD(VBG, VG)=K1\times VG+K2-VBG \quad \text{Formula 6}$$

As mentioned above, when the relationship between the exposing portion potential VL and non-exposing portion potential VO to the grid bias voltage VG (coefficients K1 to K4) is already known, by deciding the developing contrast voltage VC and background voltage VBG, the grid bias voltage VG and developing bias voltage VD according to them can be calculated uniquely using Formula 5 and Formula 6.

Namely, on the basis of the relationship (coefficients K1 to K4) between the exposing portion potential VL and non-exposing portion potential VO to the grid bias voltage VG which is stored beforehand in the data memory unit 58 as known data, the developing contrast voltage VC and background voltage VBG are decided.

At Step S2, the calculation unit 60 of the image quality maintaining control unit 54 reads the coefficients K1 to K4 stored beforehand in the data memory unit 58 as known data.

At Step S3, the calculation unit 60, on the basis of the read coefficients K1 and K4, calculates the standard developing contrast voltage VC and background voltage VBG and calculates the grid bias voltage VG and developing bias voltage VD corresponding to the calculated standard developing contrast voltage VC and standard background voltage VBG.

Figure 8:
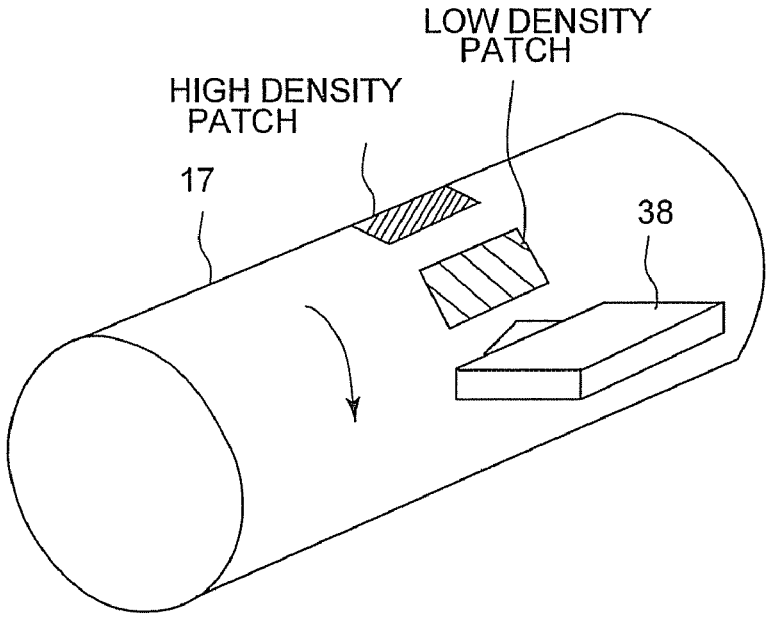
FIG. 8 is a drawing for explaining the high density pattern area and low density pattern area which are formed on the photosensitive drum.
Figure 9:
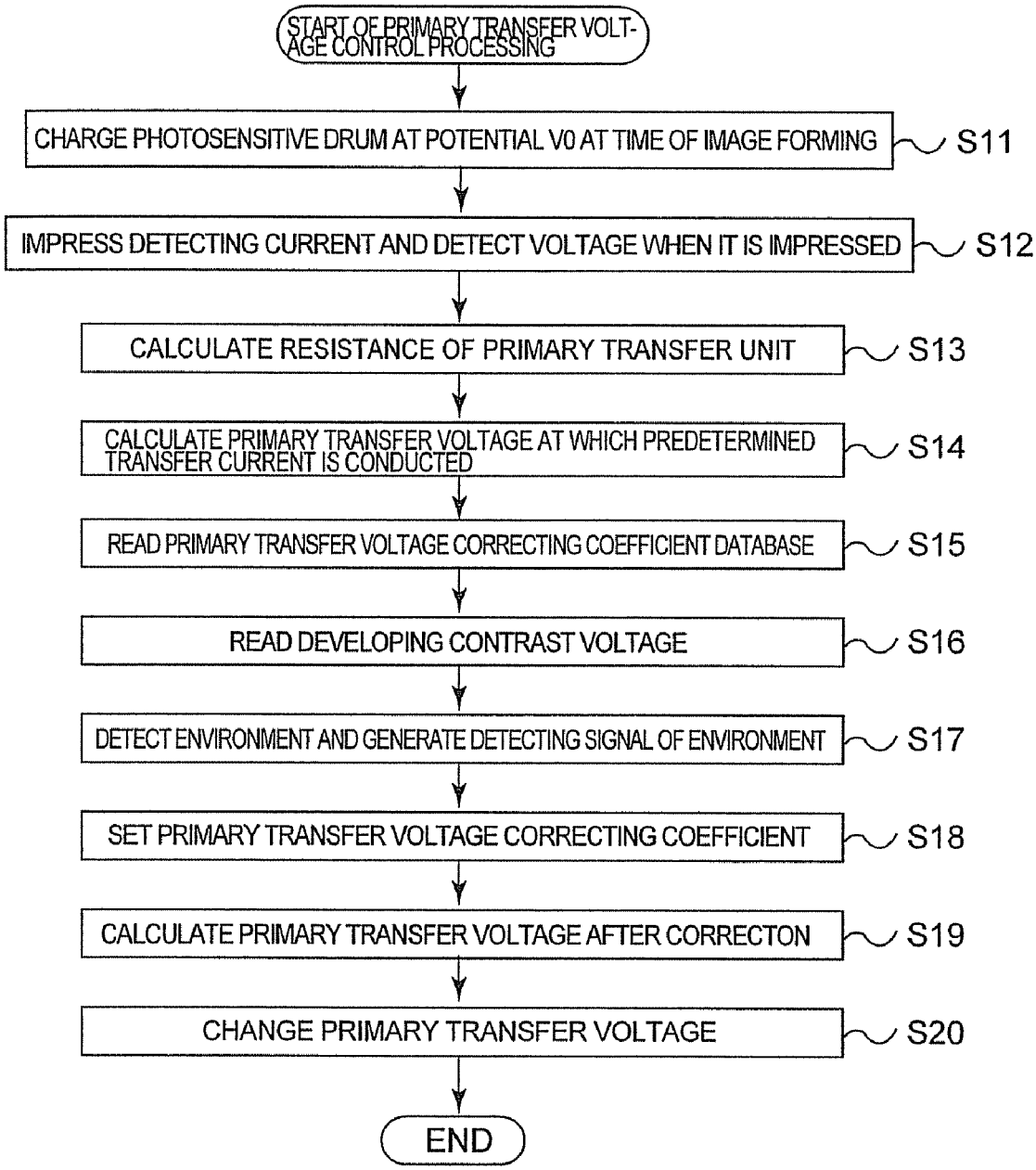
FIG. 9 is a flow chart for explaining the primary transfer control processing of the image forming apparatus shown in FIG. 2.

The main control unit 51 controls the respective units of the image forming apparatus 1 so as to perform the developing process on the basis of the calculated standard developing contrast voltage VC, the background voltage VBG, and the grid bias voltage VG and developing bias voltage VD corresponding to them and as shown in FIG. 8, form a high density pattern area (high density patch) corresponding to gradation data of a high density pattern and a low density pattern area (low density patch) corresponding to a gradation pattern of low density which is lower in density than the high density pattern on the photosensitive drum 17.

At Step S4, the toner adherence amount measuring unit 44, after the gradation patterns of high density and low density exposed on the photosensitive drum 17 are developed by the black developing device 20, in synchronization with movement of the toner adherence amount measuring unit 44 to a measurable position, measures the toner adherence amount on the photosensitive drum 17 and supplies the measured data of the toner adherence amount to the comparison and determination unit 61.

At Step S5, the comparison and determination unit 61 obtains the measured data of the toner adherence amount supplied from the toner adherence amount measuring unit 44 and reads a predetermined standard value of the toner adherence amount pre-stored in the data memory unit 58. The comparison and determination unit 61 refers to the read predetermined standard value of the toner adherence amount, compares it on the basis of the obtained measured data of the toner adherence amount, and decides whether the measured data is within the tolerance or not.

When it is decided that the measured data of the toner adherence amount which is obtained at Step S5 is not within the tolerance, the comparison and determination unit 61 supplies the comparison and determination result to the calculation unit 60. At Step S6, the calculation unit 60 calculates a deviation on the basis of the comparison and determination result supplied from the comparison and determination unit 61. At Step S7, the calculation unit 60 calculates the correcting developing contrast voltage ΔVC and correcting background voltage ΔVBG on the basis of the calculated deviation.

At Step S8, the calculation unit 60, on the basis of the standard developing contrast voltage VC and background voltage VBG and the calculated correcting developing contrast voltage ΔVC and correcting background voltage ΔVBG, calculates the developing contrast voltage VC and background voltage VBG which are impressed and calculates the grid bias voltage VG and developing bias voltage VD corresponding to them. Thereafter, the process returns to Step S4 and the processes at Step S4 and subsequent steps are repeated. Namely, the main control unit 51 controls the respective units of the image forming apparatus 1 so as to perform the developing process on the basis of the calculated standard developing contrast voltage VC, the background voltage VBG, and the grid bias voltage VG and developing bias voltage VD corresponding to them and form a high density pattern area (high density patch) and a low density pattern area (low density patch) on the photosensitive drum 17, and the toner adherence amount is measured by the toner adherence amount measuring unit 44 and is compared with the predetermined standard value, and the similar process is repeated until it is decided that the measured data is within the tolerance.

By doing this, an appropriate developing contrast voltage VC, the background voltage VBG, and the grid bias voltage VG and developing bias voltage VD corresponding to them can be calculated.

When it is decided that the measured data of the toner adherence amount which is obtained at Step S5 is not within the tolerance, the comparison and determination unit 61 supplies the comparison and determination result to the calculation unit 60. The calculation unit 60, on the basis of the comparison and determination result supplied from the comparison and determination unit 61, compares the measured data with the predetermined standard value, recognizes that it is within the tolerance, and supplies the present developing contrast voltage VC and background voltage VBG and calculation results of the grid bias voltage VG and developing bias voltage VD corresponding to them to the developing voltage changing unit 62.

At Step S9, the developing voltage changing unit 62, on the basis of the calculation results supplied from the calculation unit 60, changes the developing contrast voltage VC, background voltage VBG, grid bias voltage VG, and developing bias voltage VD. The developing voltage changing unit 62 supplies the data concerning the developing contrast voltage VC, background voltage VBG, grid bias voltage VG, and developing bias voltage VD which are changed to the data memory unit 58.

The primary transfer voltage control processing of the image forming apparatus 1 shown in FIG. 2 will be explained by referring to the flow chart shown in FIG. 8.

At Step S11, the photosensitive drum surface potential setting unit 63 reads the data concerning the changed grid bias voltage VG stored in the data memory unit 58. The photosensitive drum surface potential setting unit 63 controls the main charger 18, on the basis of the data concerning the read changed grid bias voltage VG, impresses the grid bias voltage VG to charge the photosensitive drum 17 at the appropriate voltage VO at time of image forming.

At Step S12, the primary transfer voltage detecting unit 46 impresses a predetermined current (detecting current) to the primary transfer unit, after a lapse of a predetermined time (that is, after the detecting current to be impressed is stabilized), according to an instruction of the main control unit 51, detects a voltage applied when the detecting current is impressed to the primary transfer unit, generates a primary transfer voltage detecting signal, and supplies it to the primary transfer voltage calculation unit 64. Further, the primary transfer voltage detecting signal includes the data concerning the voltage detected when the predetermined current (detecting current) is impressed to the primary transfer unit.

At Step S13, the primary transfer voltage calculation unit 64, on the basis of the predetermined current (detecting current) impressed to the primary transfer unit and the primary transfer voltage detecting signal supplied from the primary transfer voltage detecting unit 46, calculates the resistance of the primary transfer unit.

At Step S14, the primary transfer voltage calculation unit 64, on the basis of the calculated resistance of the primary transfer unit, calculates a standard primary transfer voltage for generating a predetermined transfer current. When the detecting current and predetermined transfer current are the same, the voltage detected practically becomes straight the primary transfer voltage, though actually, the resistance of toner is added, so that, generally, the primary transfer voltage is higher than the detected voltage.

At Step S15, the primary transfer voltage correcting coefficient setting unit 65, according to an instruction of the main control unit, reads the primary transfer voltage correcting coefficient database managed by the correcting coefficient database 59.

FIG. 10A shows an example of the primary transfer voltage correcting coefficient database managed by the correcting coefficient database 59. Further, as shown in FIGS. 10A and 10B, the correcting coefficient database 59 is composed of the primary transfer voltage correcting coefficient database and secondary transfer voltage correcting coefficient database.

In the first to fifth rows of the primary transfer voltage correcting coefficient database shown in FIG. 10A, "Relative humidity (%)", "Lower limit threshold value (V)", "Higher limit threshold value (V)", "∂", and "β" are recorded and they indicate respectively a value of relative humidity in the image forming apparatus 1, a lower limit threshold value of the developing contrast voltage VC at which the toner charge amount can be considered to be within the predetermined value range, a higher limit threshold value of the developing contrast voltage VC at which the toner charge amount can be considered to be within the predetermined value range, a correcting coefficient ∂ of the primary transfer voltage in the low charging area, and a correcting coefficient β of the primary transfer voltage in the high charging area.

In the first line shown in FIG. 10A, "Relative humidity (%)" is "~29.9%", indicating that the relative humidity in the image forming apparatus 1 is ~29.9%. "Lower limit threshold value (V)" is "200 V", indicating that the lower limit threshold value of the developing contrast voltage VC at which the toner charge amount can be considered to be within the predetermined value range is 200 V. "Higher limit threshold value (V)" is "400 V", indicating that the higher limit threshold value of the developing contrast voltage VC at which the toner charge amount can be considered to be within the predetermined value range is 400 V. "∂" is "0.95", indicating that the correcting coefficient of the primary transfer voltage in the low charging area is 0.95. "β" is "1.05", indicating that the correcting coefficient of the primary transfer voltage in the high charging area is 1.05.

In the second line shown in FIG. 10A, "Relative humidity (%)" is "30.0~49.9%", indicating that the relative humidity in the image forming apparatus 1 is 30.0~49.9%. "Lower limit threshold value (V)" is "180 V", indicating that the lower limit threshold value of the developing contrast voltage VC at which the toner charge amount can be considered to be within the predetermined value range is 180 V. "Higher limit threshold value (V)" is "380 V", indicating that the higher limit threshold value of the developing contrast voltage VC at which the toner charge amount can be considered to be within the predetermined value range is 380 V. "∂" is "0.90", indicating that the correcting coefficient of the primary transfer voltage in the low charging area is 0.90. "β" is "1.10", indicating that the correcting coefficient of the primary transfer voltage in the high charging area is 1.10.

In the third line shown in FIG. 10A, "Relative humidity (%)" is "45.0~59.9%", indicating that the relative humidity in the image forming apparatus 1 is 45.0~59.9%. "Lower limit threshold value (V)" is "160 V", indicating that the lower limit threshold value of the developing contrast voltage VC at which the toner charge amount can be considered to be within the predetermined value range is 160 V. "Higher limit threshold value (V)" is "360 V", indicating that the higher limit threshold value of the developing contrast voltage VC at which the toner charge amount can be considered to be within the predetermined value range is 360 V. "∂" is "0.90", indicating that the correcting coefficient of the primary transfer voltage in the low charging area is 0.90. "β" is "1.10", indicating that the correcting coefficient of the primary transfer voltage in the high charging area is 1.10.

In the fourth line shown in FIG. 10A, "Relative humidity (%)" is "60.0~74.9%", indicating that the relative humidity in the image forming apparatus 1 is 60.0~74.9%. "Lower limit threshold value (V)" is "140 V", indicating that the lower limit threshold value of the developing contrast voltage VC at which the toner charge amount can be considered to be within the predetermined value range is 140 V. "Higher limit threshold value (V)" is "340 V", indicating that the higher limit threshold value of the developing contrast voltage VC at which the toner charge amount can be considered to be within the predetermined value range is 340 V. "∂" is "0.85", indicating that the correcting coefficient of the primary transfer voltage in the low charging area is 0.85. "β" is "1.15", indicating that the correcting coefficient of the primary transfer voltage in the high charging area is 1.15.

In the fifth line shown in FIG. 10A, "Relative humidity (%)" is "75.0%~", indicating that the relative humidity in the image forming apparatus 1 is 75.0%~. "Lower limit threshold value (V)" is "120 V", indicating that the lower limit threshold value of the developing contrast voltage VC at which the toner charge amount can be considered to be within the predetermined value range is 120 V. "Higher limit threshold value (V)" is "320 V", indicating that the higher limit threshold value of the developing contrast voltage VC at which the toner charge amount can be considered to be within the predetermined value range is 320 V. "∂" is "0.80", indicating that the correcting coefficient of the primary transfer voltage in the low charging area is 0.80. "β" is "1.20", indicating that the correcting coefficient of the primary transfer voltage in the high charging area is 1.20.

At Step S16, the primary transfer voltage correcting coefficient setting unit 65 reads the data concerning the developing contrast voltage VC stored in the data memory unit 58.

At Step S17, the environment detecting unit 45, according to an instruction of the main control unit 51, detects the environment (temperature, relative humidity, etc.) inside the image forming apparatus 1, generates an environment detecting signal, and supplies it to the primary transfer voltage correcting coefficient setting unit 65. The environment detecting signal includes the data concerning the environment inside the image forming apparatus 1.

At Step S18, the primary transfer voltage correcting coefficient setting unit 65 refers to the primary transfer voltage correcting coefficient database managed by the read correcting coefficient database 59 and on the basis of the data concerning the read developing contrast voltage VC and the environment detecting signal supplied from the environment detecting unit 45, sets the primary transfer voltage correcting coefficient.

Concretely, in the example shown in FIG. 10A, when the relative humidity is 35% and the developing contrast voltage VC is 450 V, it is in the high charging area, so that the primary transfer voltage correcting coefficient is set to 1.10.

By doing this, the primary transfer voltage correcting coefficient according to the toner charge amount and environment can be set.

The primary transfer voltage correcting coefficient setting unit 65 supplies the primary transfer voltage correcting coefficient data which is the data of the primary transfer voltage correcting coefficient to the primary transfer voltage calculation unit 64.

At Step S19, the primary transfer voltage calculation unit 64 obtains the primary transfer voltage correcting coefficient data supplied from the primary transfer voltage correcting coefficient setting unit 65, on the basis of the obtained primary transfer voltage correcting coefficient data and the calculated standard primary transfer voltage, calculates the primary transfer voltage after correction according to the toner charge amount (that is, calculates a value obtained by multiplying the standard primary transfer voltage by the primary transfer voltage correcting coefficient), and supplies the calculated results to the primary transfer voltage changing unit 66.

At Step S20, the primary transfer voltage changing unit 66 changes the primary transfer voltage on the basis of the calculation results supplied from the primary transfer voltage calculation unit 64.

In the image forming apparatus 1 indicated in the embodiment of the present invention, the primary transfer voltage correcting coefficient database managed by the correcting coefficient database 59 is referred to, thus on the basis of the data concerning the developing contrast voltage VC changed by the image quality maintaining control processing and the environment data (data concerning the temperature and relative humidity) included in the environment detecting signal supplied from the environment detecting unit 45, the primary transfer voltage correcting coefficient can be set. By doing this, when the toner charge amount is shifted greatly from the predetermined standard value range, the primary transfer voltage can be corrected on the basis of the set primary transfer voltage correcting coefficient. Therefore, even if the toner charge amount and environment are changed, a satisfactory transfer property can be obtained.

Figure 11:
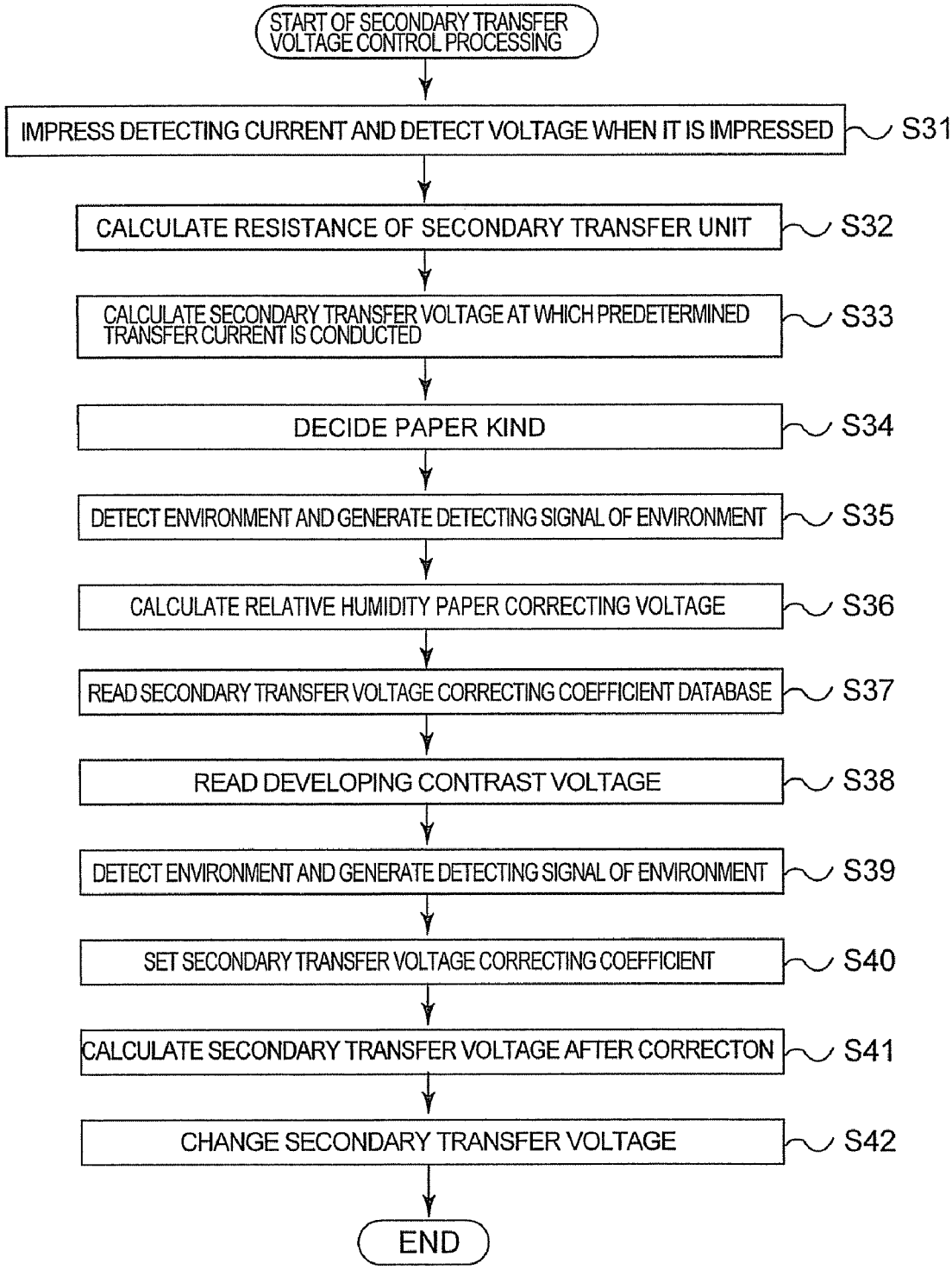
FIG. 11 is a flow chart for explaining the secondary transfer control processing of the image forming apparatus shown in FIG. 2.

Next, the secondary transfer voltage control processing of the image forming apparatus 1 shown in FIG. 2 will be explained by referring to the flow charts shown in FIG. 11.

At Step S31, the secondary transfer voltage detecting unit 47 impresses a predetermined current (detecting current) to the secondary transfer unit, after a lapse of a predetermined time (that is, after the detecting current to be impressed is stabilized), according to an instruction of the main control unit 51, detects a voltage applied when the detecting current is impressed to the secondary transfer unit, generates a secondary transfer voltage detecting signal, and supplies it to the secondary transfer voltage calculation unit 67. Further, the secondary transfer voltage detecting signal includes the data concerning the voltage detected when the predetermined current (detecting current) is impressed to the secondary transfer unit.

At Step S32, the secondary transfer voltage calculation unit 67, on the basis of the predetermined current (detecting current) impressed to the secondary transfer unit and the secondary transfer voltage detecting signal supplied from the secondary transfer voltage detecting unit 47, calculates the resistance of the secondary transfer unit.

At Step S33, the secondary transfer voltage calculation unit 67, on the basis of the calculated resistance of the secondary transfer unit, calculates a standard secondary transfer voltage for generating a predetermined transfer current. When the detecting current and predetermined transfer current are the same, the voltage detected practically becomes straight the secondary transfer voltage, though when the processing speed is different, the predetermined transfer current is different, so that the detected voltage may be different from the secondary transfer voltage.

At Step S34, the correcting voltage calculation unit 68 reads the print data stored in the data memory unit 58 and decides the paper kind on the basis of the data concerning the paper kind included in the read print data.

At Step S35, the environment detecting unit 45 detects the environment inside the image forming apparatus 1, generates an environment detecting signal, and supplies it to the correcting voltage calculation unit 68.

At Step S36, the correcting voltage calculation unit 68, on the basis of the decision result of the paper kind and the environment detecting signal supplied from the environment detecting unit 45, calculates a relative humidity paper correcting voltage corresponding to the paper kind and relative humidity and supplies the calculation results to the secondary transfer voltage calculation unit 67.

At Step S37, the secondary transfer voltage correcting coefficient setting unit 69, according to an instruction of the main control unit, reads the secondary transfer voltage correcting coefficient database managed by the correcting coefficient database 59.

FIG. 10B shows an example of the secondary transfer voltage correcting coefficient database managed by the correcting coefficient database 59. Further, "Relative humidity (%)", "Lower limit threshold value (V)", and "Higher limit threshold value (V)" in the first to fifth rows of the secondary transfer voltage correcting coefficient database shown in FIG. 10B are the same as "Relative humidity (%)", "Lower limit threshold value (V)", and "Higher limit threshold value (V)" in the first to fifth rows of the primary transfer voltage correcting coefficient database shown in FIG. 10A, so that the explanation thereof will be omitted to avoid repetition.

In the fourth and fifth rows shown in FIG. 10B, "γ" and "δ" are recorded and they indicate respectively a secondary transfer voltage correcting coefficient in the low charging area and a secondary transfer voltage correcting coefficient in the high charging area.

In the first line shown in FIG. 10B, "Relative humidity (%)" is "~29.9%", indicating that the relative humidity in the image forming apparatus 1 is ~29.9%. "Lower limit threshold value (V)" is "200 V", indicating that the lower limit threshold value of the developing contrast voltage VC at which the toner charge amount can be considered to be within the predetermined value range is 200 V. "Higher limit threshold value (V)" is "400 V", indicating that the lower limit threshold value of the developing contrast voltage VC at which the toner charge amount can be considered to be within the predetermined value range is 400 V. "γ" is "0.95", indicating that the secondary transfer voltage correcting coefficient in the low charging area is 0.95. "δ" is "1.05", indicating that the secondary transfer voltage correcting coefficient in the high charging area is 1.05.

In the second line shown in FIG. 10B, "Relative humidity (%)" is "30.0~44.9%", indicating that the relative humidity in the image forming apparatus 1 is 30.0~44.9%. "Lower limit threshold value (V)" is "180 V", indicating that the lower limit threshold value of the developing contrast voltage VC at which the toner charge amount can be considered to be within the predetermined value range is 180 V. "Higher limit threshold value (V)" is "380 V", indicating that the lower limit threshold value of the developing contrast voltage VC at which the toner charge amount can be considered to be within the predetermined value range is 380 V. "γ" is "0.90", indicating that the secondary transfer voltage correcting coefficient in the low charging area is 0.90. "δ" is "1.10", indicating that the secondary transfer voltage correcting coefficient in the high charging area is 1.10.

In the third line shown in FIG. 10B, "Relative humidity (%)" is "45.0~59.9%", indicating that the relative humidity in the image forming apparatus 1 is 45.0~59.9%. "Lower limit threshold value (V)" is "160 V", indicating that the lower limit threshold value of the developing contrast voltage VC at which the toner charge amount can be considered to be within the predetermined value range is 160 V. "Higher limit threshold value (V)" is "360 V", indicating that the lower limit threshold value of the developing contrast voltage VC at which the toner charge amount can be considered to be within the predetermined value range is 360 V. "γ" is "0.90", indicating that the secondary transfer voltage correcting coefficient in the low charging area is 0.90. "δ" is "1.10", indicating that the secondary transfer voltage correcting coefficient in the high charging area is 1.10.

In the fourth line shown in FIG. 10B, "Relative humidity (%)" is "60.0~74.9%", indicating that the relative humidity in the image forming apparatus 1 is 60.0~74.9%. "Lower limit threshold value (V)" is "140 V", indicating that the lower limit threshold value of the developing contrast voltage VC at which the toner charge amount can be considered to be within the predetermined value range is 140 V. "Higher limit threshold value (V)" is "340 V", indicating that the lower limit threshold value of the developing contrast voltage VC at which the toner charge amount can be considered to be within the predetermined value range is 340 V. "γ" is "0.80", indicating that the secondary transfer voltage correcting coefficient in the low charging area is 0.80. "δ" is "1.20", indicating that the secondary transfer voltage correcting coefficient in the high charging area is 1.20.

In the fifth line shown in FIG. 10B, "Relative humidity (%)" is "75.0%~", indicating that the relative humidity in the image forming apparatus 1 is 75.0%~. "Lower limit threshold value (V)" is "120 V", indicating that the lower limit threshold value of the developing contrast voltage VC at which the toner charge amount can be considered to be within the predetermined value range is 120 V. "Higher limit threshold value (V)" is "320 V", indicating that the lower limit threshold value of the developing contrast voltage VC at which the toner charge amount can be considered to be within the predetermined value range is 320 V. "γ" is "0.75", indicating that the secondary transfer voltage correcting coefficient in the low charging area is 0.75. "δ" is "1.25", indicating that the secondary transfer voltage correcting coefficient in the high charging area is 1.25.

At Step S38, the secondary transfer voltage correcting coefficient setting unit 69 reads the data concerning the developing contrast voltage VC stored in the data memory unit 58.

At Step S39, the environment detecting unit 45, according to an instruction of the main control unit 51, detects the environment (temperature, relative humidity, etc.) inside the image forming apparatus 1, generates an environment detecting signal, and supplies it to the secondary transfer voltage correcting coefficient setting unit 69. The environment detecting signal includes the data concerning the environment inside the image forming apparatus 1.

At Step S40, the secondary transfer voltage correcting coefficient setting unit 69 refers to the secondary transfer voltage correcting coefficient database managed by the read correcting coefficient database 59 and on the basis of the data concerning the read developing contrast voltage VC and the environment detecting signal supplied from the environment detecting unit 45, sets the secondary transfer voltage correcting coefficient.

Concretely, in the example shown in FIG. 10B, when the relative humidity is 48% and the developing contrast voltage VC is lower than $V_{a3}$ V, it is in the low charging area, so that the secondary transfer voltage correcting coefficient is set to $X_3$.

By doing this, the secondary transfer voltage correcting coefficient according to the toner charge amount and environment can be set.

The secondary transfer voltage correcting coefficient setting unit 69 supplies the secondary transfer voltage correcting coefficient data which is the data of the secondary transfer voltage correcting coefficient to the secondary transfer voltage calculation unit 67.

At Step S41, the secondary transfer voltage calculation unit 67 obtains the secondary transfer voltage correcting coefficient data supplied from the secondary transfer voltage correcting coefficient setting unit 69, on the basis of the obtained secondary transfer voltage correcting coefficient data, the calculated standard secondary transfer voltage, and the relative humidity paper correcting voltage, calculates the secondary transfer voltage after correction according to the toner charge amount (that is, calculates a value obtained by multiplying the sum of the standard primary transfer voltage and relative humidity correcting voltage by the secondary transfer voltage correcting coefficient), and supplies the calculated results to the secondary transfer voltage changing unit 70.

At Step S42, the secondary transfer voltage changing unit 70 changes the secondary transfer voltage on the basis of the calculation results supplied from the secondary transfer voltage calculation unit 67.

In the image forming apparatus 1 indicated in the embodiment of the present invention, the secondary transfer voltage correcting coefficient database managed by the correcting coefficient database 59 is referred to, thus on the basis of the data concerning the developing contrast voltage VC changed by the image quality maintaining control processing and the environment data (data concerning the temperature and relative humidity) included in the environment detecting signal supplied from the environment detecting unit 45, the secondary transfer voltage correcting coefficient can be set. By doing this, when the toner charge amount is shifted greatly from the predetermined standard value range, the secondary transfer voltage can be corrected on the basis of the set secondary transfer voltage correcting coefficient. Therefore, even if the toner charge amount and environment are changed, a satisfactory transfer property can be obtained.

Further, in the image forming apparatus 1 indicated in the embodiment of the present invention, the primary transfer voltage or secondary transfer voltage is calculated and then the primary transfer voltage correcting coefficient or secondary transfer voltage correcting coefficient is set on the basis of the developing contrast voltage VC. However, the present invention is not limited to it and whenever the developing contrast voltage VC is changed, the primary transfer voltage correcting coefficient or secondary transfer voltage correcting coefficient may be set.

Further, in the image forming apparatus 1 indicated in the embodiment of the present invention, the voltage range is divided into three sections (appropriate charging area, low charging area, and high charging area) depending on the value of the developing contrast voltage VC and the correcting coefficients are set so as to be difference from each other between the sections. However, the present invention is not limited to it, and the voltage range may be divided into two or four or more, and an appropriate correcting coefficient may be calculated and set according to the value of the developing contrast voltage VC. In this case, at least one section is set to the appropriate charging area.

Furthermore, in the image forming apparatus 1 indicated in the embodiment of the present invention, the toner adherence amount on the photosensitive drum 17 is measured by the image quality maintaining control processing (the flow chart shown in FIG. 6), though the toner adherence amount on the intermediate transfer belt 22 may be measured. The present invention can be applied to an image forming apparatus of a four-each tandem type. However, particularly when applying the present invention to an image forming apparatus of a four-each tandem type as shown in FIG. 12, four photosensitive drums are arranged, so that when the toner adherence amount on the intermediate transfer belt is measured, the number of toner adherence amount measures can be reduced to one, thus the cost of the image forming apparatus can be decreased.

Figure 12:
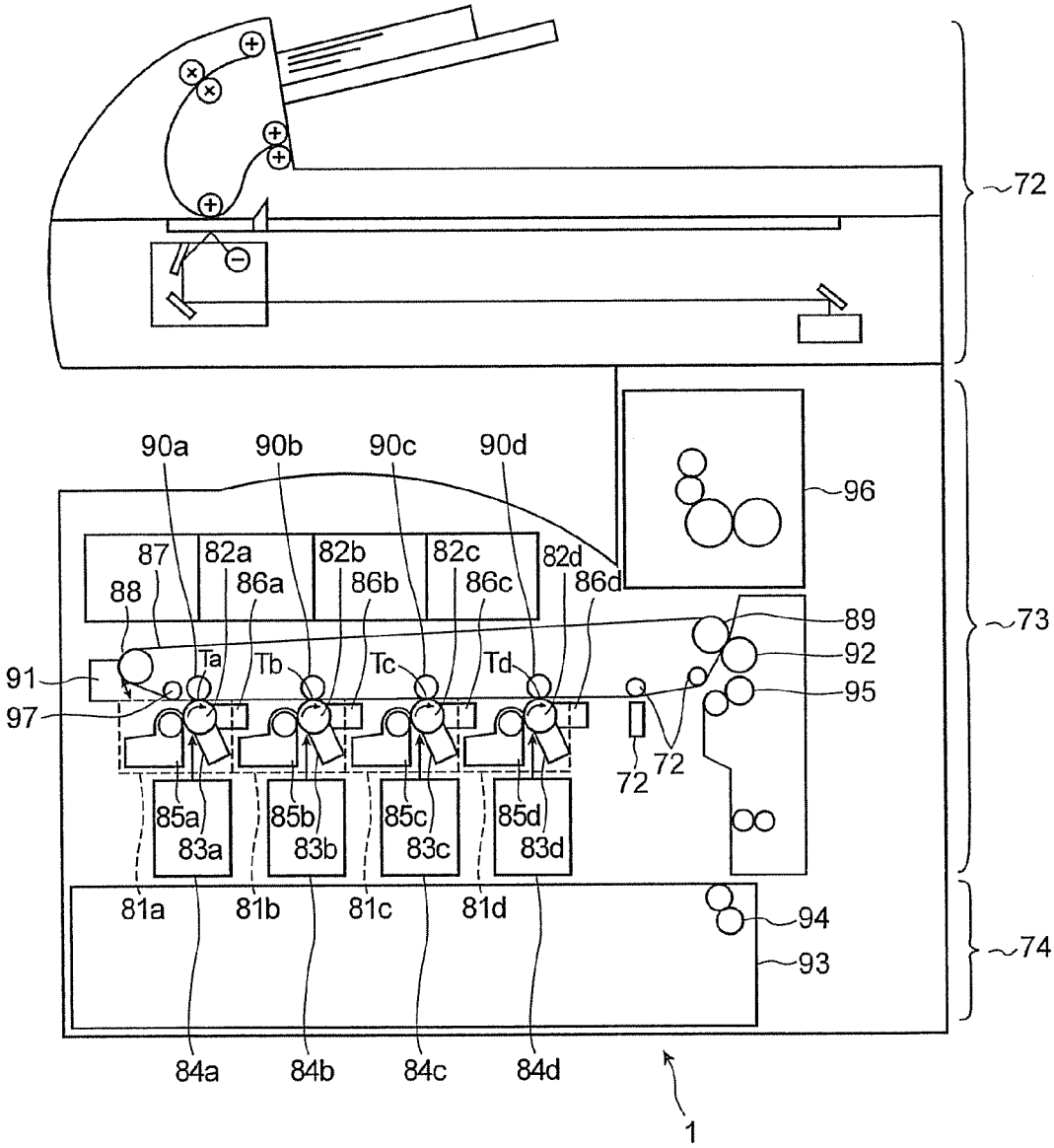
FIG. 12 is a block diagram showing the mechanical constitution of another schematic section of the image forming apparatus to which the present invention is applied.

FIG. 12 shows the mechanical constitution of another schematic section of the image forming apparatus 1 to which the present invention is applied.

As shown in FIG. 12, the image forming apparatus 1 is composed of a scanner unit 72, an image forming unit 73, and a paper supply unit 74.

The scanner unit 72 irradiates light to a document set on the document table, leads the reflected light from the document to the light receiving element via a plurality of optical members, converts it photoelectrically, and then supplies an image signal to the image forming unit 73.

Figure 13:
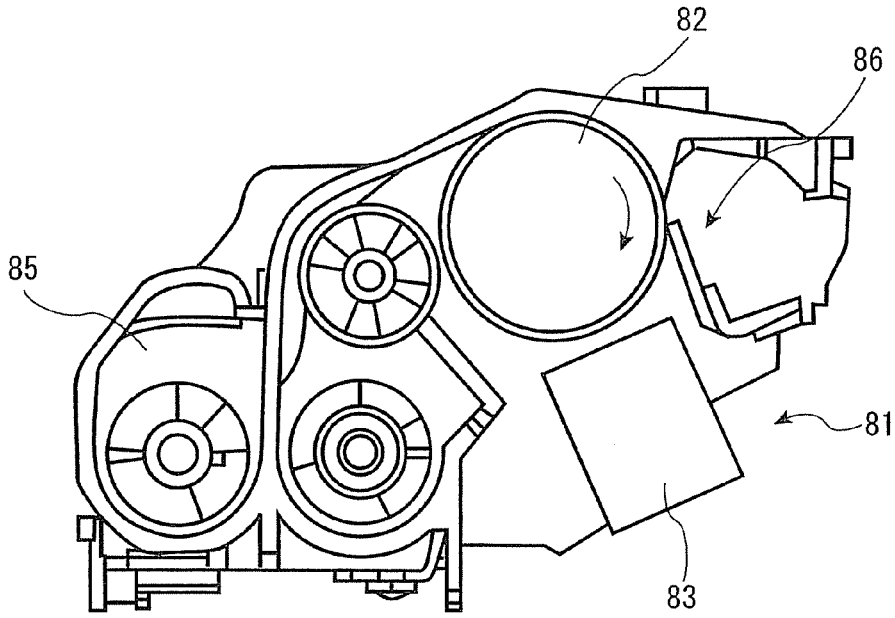
FIG. 13 is a block diagram showing the internal schematic and mechanical constitution of the process cartridge shown in FIG. 12.
Figure 14:
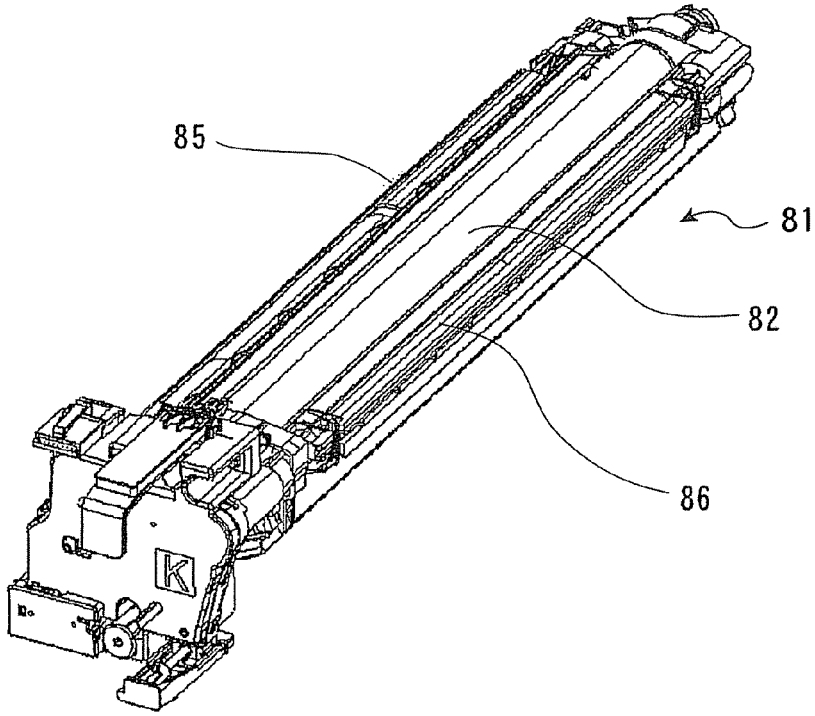
FIG. 14 is a perspective view showing the appearance constitution of the process cartridge shown in FIG. 12.

In the image forming unit 73, as shown in FIGS. 12 to 14, process cartridges 81*a*, 81*b*, 81*c*, and 81*d* are installed. The process cartridges 81*a*, 81*b*, 81*c*, and 81*d* have respectively photosensitive drums 82*a*, 82*b*, 82*c*, and 82*d* which are image carriers and on the these photosensitive drums, developer images are formed.

A process cartridge 81 includes a photosensitive drum 82, a charging unit 83, a developing device 85, and a cleaner 86 and is installed removably on the image forming apparatus 1.

The photosensitive drum 82*a* is, for example, in a cylindrical shape with a diameter of 30 mm and is installed so as to rotate in the direction of the arrow shown in the drawing. Around the photosensitive drum 82*a*, auxiliary facilities are arranged in the rotational direction. Firstly, a main charger 83*a* is installed as an auxiliary facility on the surface of the photosensitive drum 82*a* opposite to it. The main charger 83*a* charges negatively and uniformly the photosensitive drum 82*a*. On the downstream side of the main charger 83*a*, an exposure unit 84*a* for exposing the charged photosensitive drum 82*a* and forming an electrostatic latent image is installed. The exposure unit 84*a* exposes a laser beam which is photomodulated in correspondence with the image signal supplied from the scanner unit 72 to the photosensitive drum 82*a*. Further, the exposure unit 84*a* may use an LED (light emitting diode) in place of the laser beam.

Further, on the downstream side of the exposure unit 84*a*, a developing device 85*a* for storing a yellow developer and reversely developing the electrostatic latent image formed by the exposure unit 84*a* using the developer is installed. Furthermore, an intermediate transfer belt 87 which is an image formed medium is installed so as to make contact with the photosensitive drum 82*a*.

On the upstream side of the contact position of the photosensitive drum 82*a* with the intermediate transfer belt 87, a cleaner 86*a* is installed. The cleaner 86*a* removes and stores residual toner on the photoconductor after transfer. A discharging lamp not drawn neutralizes the surface charge of the photosensitive drum 82*a* by uniform light irradiation. By doing this, one cycle of image forming is completed and in the next image forming process, the main charger 83*a* uniformly charges again the uncharged photosensitive drum 82*a*.

The intermediate transfer belt 87 has a length (width) almost equal to the length of the photosensitive drum 82*a* in the direction perpendicular to the conveying direction (the depth direction of the drawing). The intermediate transfer belt 87 is in an endless shape and is stretched and suspended on a drive roller 88 for rotating the belt at a predetermined speed and a secondary transfer opposite roller 89 which is a driven roller. Further, a numeral 97 indicates a tension roller for holding the intermediate transfer belt 87 at a fixed tension.

The intermediate transfer belt 87 is a polyimide belt containing uniformly diffused carbon with a thickness of, for example, 100 μm. The intermediate transfer belt 87 has an electric resistance of $10^{-9}$ Ωcm and shows a semiconductive property. As a material of the intermediate transfer belt 87, a material having a semiconductive property of a volume resistance of $10^{-8}$ to $10^{-11}$ Ωcm is acceptable. For example, in addition to polyimide containing diffused carbon, polyethylene terephthalate, polycarbonate, polytetrafluoroethylene, or polyvinylidene fluoride in which conductive particles such as carbon are diffused may be used. A polymer film whose electric resistance is regulated by composition regulation without using conductive particles may be used. Furthermore, such a polymer film with an ion conductive material mixed or rubber materials such as silicone rubber and urethane rubber having a comparatively low electric resistance may be used.

On the intermediate transfer belt 87, between the drive roller 88 and the driven roller 89, in the conveying direction of the intermediate transfer belt 87, the process cartridge 81*a* and also the process cartridges 81*b*, 81*c*, and 81*d* are arranged sequentially. The process cartridges 81*b*, 81*c*, and 81*d* respectively have the same constitution as that of the process cartridge 81*a*.

The photosensitive drums 82*b*, 82*c*, and 82*d* are installed almost at the centers of the respective process cartridges. Opposite to the surfaces of the photosensitive drums 82*b*, 82*c*, and 82*d*, the main chargers 83*b*, 83*c*, and 83*d* are installed respectively. On the downstream side of the main chargers 83*b*, 83*c*, and 83*d*, exposure units 84*b*, 84*c*, and 84*d* for exposing the charged photosensitive drums 82*b*, 82*c*, and 82*d* and forming electrostatic latent images are installed. On the downstream side of the exposure units 84*b*, 84*c*, and 84*d*, developing devices 85*b*, 85*c*, and 85*d* for reversely developing the electrostatic latent images formed by the exposure units 84*b*, 84*c*, and 84*d* are installed. On the upstream side of the contact positions of the photosensitive drums 82*b*, 82*c*, and 82*d* with the intermediate transfer belt 87, cleaners 86*b*, 86*c*, and 86*d* are installed. Further, the developing devices 85*b*, 85*c*, and 85*d* respectively store a magenta developer, a cyan developer, and a black developer.

The intermediate transfer belt 87 makes contact sequentially with the respective photosensitive drums 82*a* to 82*d*. In the neighborhood of each contact position of the intermediate transfer belt 87 with the respective photosensitive drums, primary transfer rollers 90*a*, 90*b*, 90*c*, and 90*d* are installed in correspondence with the respective photosensitive drums. Namely, the primary transfer rollers 90*a* to 90*d* are installed so as to make contact with the rear of the intermediate transfer belt 87 above the corresponding photosensitive drums and are opposite to the process cartridges 81*a* to 81*d* via the intermediate transfer belt 87. The primary transfer rollers 90*a* to 90*d* are connected to a positive (+) DC power source (not drawn) which is a voltage impression means. Further, in the neighborhood of each of the primary transfer rollers 90*a* to 90*d*, a primary transfer roller voltage detecting unit (not drawn) for detecting the voltages impressed to the primary transfer rollers 90*a* to 90*d* is installed.

Further, in the neighborhood of the drive roller 88, an intermediate transfer belt cleaner 91 for removing and storing residual toner on the intermediate transfer belt 87 is installed.

On the other hand, on the lower part of the image forming unit 73, a paper supply cassette 93 of the paper supply unit 74 for storing sheets of paper (transfer materials) is installed. On the paper supply unit 74, a pick-up roller 94 for picking up sheets of paper one by one is installed. In the neighborhood of a secondary transfer roller 92 of the image forming unit 73, an aligning roller pair 95 is installed rotatably. The aligning roller pair 95 supplies sheets of paper to the secondary transfer unit in which the secondary transfer roller 92 and the driven roller 89 stand face to face with each other across the intermediate transfer belt 87 at predetermined timing.

Further, above the intermediate transfer belt 87, a fixing device 96 for fixing a developer on a sheet of paper is installed. The fixing device 96 applies predetermined heat and pressure to a sheet of paper holding a toner image and fixes the melted toner image to the sheet of paper.

Furthermore, at a predetermined position under the intermediate transfer belt 87, an environment sensor 98 for detecting the environment inside the image forming apparatus 1 such as temperature and relative humidity is installed.

Next, the color image forming operation (print process) of the image forming apparatus 1 will be explained.

When starting of the image forming operation is instructed (that is, starting of printing is instructed), the photosensitive drum 82*a* receives driving force from a drive mechanism not drawn and starts rotation. The main charger 83*a* charges uniformly the photosensitive drum 82*a*, for example, at −600 V. The exposure unit 84*a* irradiates light according to an image (characters) to be printed to the photosensitive drum 82*a* uniformly charged by the main charger 83*a* to form an electrostatic latent image. The developing device 85*a* stores a developer (a two-component developer of Y toner of yellow+ ferrite carrier), gives a bias value, for example, −380 V to a developing sleeve (not drawn) from a developing bias power source not drawn to form a developing electric field between the photosensitive drum 82*a* and itself. The Y toner charged negatively is adhered and reversely developed in the area irradiated with light on the photosensitive drum 82*a*.

Next, the developing device 85*b* develops the electrostatic latent image by the magenta developer and forms an M toner image of magenta on the photosensitive drum 82*b*. At this time, the M toner has a mean particle diameter of about several microns (for example, 7 microns) similarly to the Y toner and is negatively charged due to frictional charging with ferrite magnetic carrier particles (not drawn) with a mean particle diameter of about 60 microns. The developing bias value is, for example, about −380 V similarly to the developing device 85*b* and a developing bias voltage is impressed to a developing sleeve (not drawn) by a bias power source not drawn. The direction of the developing electric field is directed to the developing sleeve from the surface of the photosensitive drum 82*b* in the imaging unit and negatively charged M toner is adhered to the high potential portion of the latent image.

The developing device 85*c* develops the electrostatic latent image by the cyan developer and forms a C toner image of cyan on the photosensitive drum 82*c*. At this time, the C toner has a mean particle diameter of about several microns (for example, 7 microns) similarly to the Y toner and is negatively charged due to frictional charging with ferrite magnetic carrier particles (not drawn) with a mean particle diameter of about several tens microns (60 microns). The developing bias value is, for example, about −380 V similarly to the developing device 85*c* and a developing bias voltage is impressed to a developing sleeve (not drawn) by a bias power source not drawn. The direction of the developing electric field is directed to the developing sleeve from the surface of the photosensitive drum 82*c* in the imaging unit and negatively charged C toner is adhered to the high potential portion of the latent image.

The developing device 85*d* develops the electrostatic latent image by the black developer and forms a B toner image of black on the photosensitive drum 82*d*. At this time, the B toner has a mean particle diameter of about several microns (for example, 7 microns) similarly to the Y toner and is negatively charged due to frictional charging with ferrite magnetic carrier particles (not drawn) with a mean particle diameter of about several tens microns (for example, 60 microns). The developing bias value is, for example, about −380 V similarly to the developing device 85*d* and a developing bias voltage is impressed to a developing sleeve (not drawn) by a bias power source not drawn. The direction of the developing electric field is directed to the developing sleeve from the surface of the photosensitive drum 82*d* in the imaging unit and negatively charged B toner is adhered to the high potential portion of the latent image.

In a transfer area Ta formed by the photosensitive drum 82*a*, intermediate transfer belt 87, and primary transfer roller 90*a*, to the primary transfer roller 90*a*, a required voltage, for example, a bias voltage of about +1000 V is impressed. Between the primary transfer roller 90*a* and the photosensitive drum 82*a*, a transfer electric field is formed and the Y toner image on the photosensitive drum 82*a* is transferred onto the intermediate transfer belt 87 according to the transfer electric field.

The constitution of the primary transfer rollers 90*b*, 90*c*, and 90*d* is basically the same as that of the primary transfer roller 90*a* and the explanation thereof will be omitted to avoid repetition.

An image on the intermediate transfer belt 87 to which the Y toner image is transferred in the transfer area Ta is conveyed toward a transfer area Tb. In the transfer area Tb, a required voltage, for example, a bias voltage of about +1200 V is impressed to the primary transfer roller 90*b* from the DC power source, thus the M toner image of magenta is superimposed on the Y toner image. In a transfer area Tc, a required voltage, for example, a bias voltage of about +1400 V is impressed to the primary transfer roller 90*c* and in a transfer area Td, a required voltage, for example, a voltage of about +1700 V is impressed to the primary transfer roller 90*d*, thus on the developer images already transferred, the cyan developer image and black developer image are sequentially multitransferred. On the other hand, the pick-up roller 94 takes out a sheet of paper from the paper supply cassette 93 and the aligning roller pair 95 supplies the sheet of paper to the secondary transfer unit.

In the secondary transfer unit, the required bias voltage is impressed to the driven roller 89, and a transfer electric field is formed between the driven roller 89 and the secondary transfer roller 92 across the intermediate transfer belt 87, and the multiple color toner images on the intermediate transfer belt 87 are transferred to a sheet of paper in a batch. The developer images of various colors transferred in a batch in this way are fixed on the sheet of paper by the fixing device 96 and a color image is formed. The fixed sheet of paper is ejected onto an intra-body paper ejection unit (not drawn).

Further, the embodiment of the present invention indicates the processing examples in which the steps of the flow charts are executed in time series in the order of recording, though it includes processes performed in parallel or individually instead of in time series.

According to the present invention, even if the toner charge amount and environment are changed, a satisfactory transfer property can be obtained.

What is claimed is:

1. An image forming apparatus comprising:

control means for controlling a developing contrast voltage so as to obtain a desired image density;

transfer condition control means for controlling transfer conditions for transferring a toner image;

environment detecting means for detecting an environment; and correcting coefficient setting means for referring to a database for pre-registering correcting coefficients for correcting the transfer conditions corresponding to the developing contrast voltage and environment and setting the correcting coefficients on the basis of the developing contrast voltage controlled by the control means and the environment detected by the environment detecting means.

2. The apparatus according to claim 1, wherein the developing contrast voltage is a difference voltage between a potential of a surface of an image carrier on which an image is formed and a developing bias potential.

3. The apparatus according to claim 1, wherein the transfer condition control means corrects the transfer conditions on the basis of the correcting coefficients set by the correcting coefficient setting means.

4. The apparatus according to claim 1, wherein the environment detecting means detects at least relative humidity.

5. The apparatus according to claim 1, wherein the correcting coefficients pre-registered in the database are different from each other between a plurality of sections divided beforehand according to the developing contrast voltage.

6. The apparatus according to claim 5, wherein the plurality of sections divided according to the developing contrast voltage are any one of a low charging area in which a toner charge amount is small, an appropriate charging area in which the toner charge amount is within a predetermined standard value range, and a high charging area in which the toner charge amount is large, and the correcting coefficients pre-registered in the database are respectively a value smaller than 1, a value of 1, and a value larger than 1 in the low charging area, the appropriate charging area, and the high charging area.

7. The apparatus according to claim 1, wherein the correcting coefficients pre-registered in the database are values according to the environment.

8. An image forming method comprising:

controlling a developing contrast voltage so as to obtain a desired image density;

controlling transfer conditions for transferring a toner image;

detecting an environment; and referring to a database for pre-registering correcting coefficients for correcting the transfer conditions corresponding to the developing contrast voltage and the environment and setting the correcting coefficients on the basis of the developing contrast voltage controlled and the environment detected.

9. The method according to claim 8, wherein the developing contrast voltage is a difference voltage between a potential of a surface of an image carrier on which an image is formed and a developing bias potential.

10. The method according to claim 8, wherein on the basis of the set correcting coefficients, the transfer conditions are corrected.

11. The method according to claim 8, wherein the environment detected is at least relative humidity.

12. The method according to claim 8, wherein the correcting coefficients pre-registered in the database are different from each other between a plurality of sections divided beforehand according to the developing contrast voltage.

13. The method according to claim 12, wherein the plurality of sections divided according to the developing contrast voltage are any one of a low charging area in which a toner charge amount is small, an appropriate charging area in which the toner charge amount is within a predetermined standard value range, and a high charging area in which the toner charge amount is large, and the correcting coefficients pre-registered in the database are respectively a value smaller than 1, a value of 1, and a value larger than 1 in the low charging area, the appropriate charging area, and the high charging area.

14. The method according to claim 8, wherein the correcting coefficients pre-registered in the database are values according to the environment.

15. An image forming apparatus comprising:

a developing contrast voltage controller to control a developing contrast voltage so as to obtain a desired image density;

a transfer condition controller to control transfer conditions for transferring a toner image;

an environment sensor to detect an environment; and a correcting coefficient setting unit to refer to a database for pre-registering correcting coefficients to correct the transfer conditions corresponding to the developing contrast voltage and environment and set the correcting coefficients on the basis of the developing contrast voltage controlled by the developing contrast voltage controller and the environment detected by the environment sensor.

16. The apparatus according to claim 15, wherein the developing contrast voltage is a difference voltage between a potential of a surface of an image carrier on which an image is formed and a developing bias potential.

17. The apparatus according to claim 15, wherein the transfer condition controller corrects the transfer conditions on the basis of the correcting coefficients set by the correcting coefficient setting unit.

18. The apparatus according to claim 15, wherein the correcting coefficients pre-registered in the database are different from each other between a plurality of sections divided beforehand according to the developing contrast voltage.

19. The apparatus according to claim 18, wherein the plurality of sections divided according to the developing contrast voltage are any one of a low charging area in which a toner charge amount is small, an appropriate charging area in which the toner charge amount is within a predetermined standard value range, and a high charging area in which the toner charge amount is large, and the correcting coefficients pre-registered in the database are respectively a value smaller than 1, a value of 1, and a value larger than 1 in the low charging area, the appropriate charging area, and the high charging area.

20. The apparatus according to claim 15, wherein the correcting coefficients pre-registered in the database are values according to the environment.

* * * * *